US008950230B2

(12) United States Patent
Smith et al.

(10) Patent No.: US 8,950,230 B2
(45) **Date of Patent: *Feb. 10, 2015**

(54) FABRICATION MEMBER

(71) Applicant: KRIP LLC, Auburn, AL (US)

(72) Inventors: Jeremy Ryan Smith, Carrollton, VA (US); Kennon Whaley, Montgomery, AL (US)

(73) Assignee: Krip, LLC, Auburn, AL (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/067,450

(22) Filed: Oct. 30, 2013

(65) Prior Publication Data

US 2014/0047893 A1 Feb. 20, 2014

Related U.S. Application Data

(63) Continuation of application No. 13/936,449, filed on Jul. 8, 2013.

(60) Provisional application No. 61/680,777, filed on Aug. 8, 2012.

(51) Int. Cl.
*B21C 37/06* (2006.01)
*B21D 51/02* (2006.01)
(Continued)

(52) U.S. Cl.
CPC *B21D 51/02* (2013.01); *B21D 5/16* (2013.01); *B21D 5/008* (2013.01); *B21C 37/06* (2013.01); *B21D 47/04* (2013.01)
USPC ..... 72/368; 72/51; 72/367.1

(58) Field of Classification Search
CPC ..... B21C 37/08; B21C 37/0803; B21C 37/0822; B21C 37/15; B21C 37/083; B21D 47/01
USPC ..... 72/48, 51, 367.1, 368, 370.14
See application file for complete search history.

(56) References Cited

U.S. PATENT DOCUMENTS 3,469,067 A 9/1969 Ogden et al.
4,251,973 A 2/1981 Paik
(Continued)

FOREIGN PATENT DOCUMENTS

WO WO 2010136016 A1 * 12/2010

OTHER PUBLICATIONS

R. Baumer et al., "Transient High-Frequency Welding Simulations of Dual-Phase Steels", Supplement to The Welding Journal, Oct. 2009, pp. 193-s-201-s.

*Primary Examiner* — Debra Sullivan
(74) *Attorney, Agent, or Firm* — Hahn Loeser & Parks, LLP

(57) ABSTRACT

A method of making a composite tube-shaped fabrication member by providing in coils a first planar member suitable to form a flange of a tube-shaped fabrication member, two second planar members suitable to form web portions of a tube-shaped frame member, and two third planar members suitable to form a portion of a flange of the tube-shaped member, uncoiling the coils fo first, second, and third planar members and passing them through accumulators, aligning the first, second, and third planar members adjacent respective side portions and attaching side portions of each planar member to respective side portions of adjacent planar members to form a composite intermediate product, and cold-forming to form a composite fabrication member of a desired shape.

30 Claims, 14 Drawing Sheets

(51) Int. Cl.

| | |
|---|---|
| ***B21D 5/16*** | (2006.01) |
| ***B21D 5/00*** | (2006.01) |
| *B21D 47/04* | (2006.01) |

(56) References Cited

U.S. PATENT DOCUMENTS

| | | | | | |
|---|---|---|---|---|---|
| 5,163,225 | A | | 11/1992 | Goleby | |
| 5,373,679 | A | | 12/1994 | Goleby | |
| 5,403,986 | A | | 4/1995 | Goleby | |
| 5,501,053 | A | | 3/1996 | Goleby | |
| 5,600,932 | A | | 2/1997 | Paik et al. | |
| 5,924,316 | A | * | 7/1999 | Streubel et al. | 72/51 |
| 2008/0028720 | A1 | | 2/2008 | Bartlett et al. | |
| 2008/0289390 | A1 | | 11/2008 | Bartlett et al. | |
| 2008/0290140 | A1 | | 11/2008 | Bartlett et al. | |
| 2011/0162320 | A1 | | 7/2011 | Bartlett et al. | |

* cited by examiner

FABRICATION MEMBER

This application is a continuation of and claims priority to U.S. patent application Ser. No. 13/936,449 filed Jul. 8, 2013, which claims priority to U.S. Provisional Patent Application No. 61/680,777 filed Aug. 8, 2012, the contents of which are hereby incorporated in their entirety.

BACKGROUND AND SUMMARY

This invention relates to the manufacture of improved fabrication members, in particular, the manufacturing of fabrication members having properties to create more effective and efficient fabrication members.

Frame members are made from a variety of materials used for many different applications. Fabrication members are used in applications where increased load is exerted in a structure. For example, such loads in buildings may comprise the gravitational load exerted by the weight of the building, the loads exerted by the manner in which the building is used, and loads exerted by the environment, such as from wind and seismic activity. For further example, such loads in vehicles may be exerted by the weight of the vehicle, by the cargo carried by the vehicle, or the manner in which the vehicle is used; additionally, such loads may be exerted by collisions. In each instance, the structure has to be reinforced, compared to less-load-bearing areas, in order to maintain the structural integrity of the building or vehicle.

It is customary for the designer of structures to specify the load-bearing qualities which must be exhibited by each of the components comprised in the structure. Special attention is paid to the special load-bearing components. Typically these load-bearing components are formed from a single strip of raw material having relatively uniform thickness and substantially uniform properties across the entire sheet. Examples of such members used in structures include cold-formed steel metal studs used in walls, metal building purlins used in roofs and walls, or curtainwall members or large windows. Such structures have been customarily made from a single piece of metal strip material which is cold-formed through a series of mechanical passes in order to shape them into the desired structure. As a result, the previous cold-formed fabrication members have a relatively uniform thickness throughout the entire structure, including areas of the structure which carry less load. These previous fabrication members, therefore, comprise more material than is necessary to perform their desired function.

These fabrication members often comprise one or more web portions and one or more flange portions. Generally, the web-portion having different mechanical properties to bear shear and torsional forces along the length of the web portion and between flange portions. Tube-shaped fabrication members often comprise two web portions connecting two flange portions. Generally, these fabrication members are formed from a single metal strip with the web portions the same dimensions and mechanical properties as the flanges. The specifications of the flange members providing for a desired material and desired dimensions of the fabrication members. Generally, however, the loads applied to the web portions require less material than the loads applied to the flange portions. There is, therefore, a need for a fabrication member meeting the desired load-bearing requirements, while also having a more effective and efficient structure.

Presently disclosed is a method of making a composite tube-shaped fabrication member comprising the steps of: providing in a coil a first planar member having a desired cross-sectional shape and a desired first set of mechanical properties suitable to form a flange of a tube-shaped fabrication member; providing in coils two second planar members having a desired cross-sectional shape and a desired second set of mechanical properties different from the first planar member suitable to form web portions of a tube-shaped frame member; providing in coils two third planar members each having a desired cross-sectional shape and a desired third set of mechanical properties suitable to form a portion of a flange of the tube-shaped member; uncoiling and passing through accumulators a third planar member, a second planar member, the first planar member, a second planar member, and a third planar member, the accumulators allowing sufficient delay to permit for welding of end portions of coils to enable continuous flow of first planar member, second planar members, and third planar members; aligning side portions of first planar member and second planar member and side portions of the first planar member and third planar member for attachment; attaching side portions of the first planar member and the two third planar members to respective side portions of two second planar members by induction welding to form a composite intermediate product as a continuum of a third planar member, a second planar member, the first planar member, a second planar member and a third planar member, suitable for forming a tube-shaped composite fabrication member; and cold-forming the composite intermediate product to form a composite fabrication member of a tube-shape with the first planar member forming flange portions, the second planar members forming web portions, and the two third planar members forming a flange portion of the tube-shaped composite fabrication member. The method may also comprise attaching the two third planar members together by welding to form a continuous flange of the tube-shaped fabrication member.

In some embodiments the step of cold-forming imparts bends in the first and third planar members adjacent transitions between the first and second planar members and the second and third planar members to form a box-shaped fabrication member. In other embodiments the step of cold-forming may impart a profile into the first, second and third planar members to form a curvilinear-shaped tubular fabrication member. Furthermore, in embodiments, the step of attaching the first and third planar members to the second planar members is performed with the step of cold-forming to form a composite fabrication member having a tube-shape. Alternatively, or in addition, the step of attaching the two third planar members by welding to form the tube-shaped composite fabrication member may be performed with the step of cold-forming to form a composite fabrication member having a tube-shape.

The presently disclosed method of making a composite fabrication member may further comprise the step of forming perforations, embossments, or knurling in the composite intermediate product and/or the composite fabrication member.

Also disclosed is a method of making a composite intermediate fabrication product comprising the steps of: providing in a coil a first planar member having a desired cross-sectional shape and a desired first set of mechanical properties suitable to form a flange of a tube-shaped fabrication member; providing in coils two second planar member having a desired cross-sectional shape and a desired second set of mechanical properties different from the first planar members suitable to form a web portion of a tube-shaped frame member; providing in coils two third planar members each having a desired cross-sectional shape and a desired third set of mechanical properties suitable to form a portion of a flange of the tube-shaped member; uncoiling and passing through accumulators a third planar member, a second planar member, the first planar member, a second planar member, and a third planar member, the accumulators allowing sufficient delay to permit for welding of end portions of coils to enable continuous flow of first planar member, second planar members, and third planar members; aligning side portions of first planar member and second planar member and side portions of the first planar member and third planar member for attachment; and attaching side portions of the first planar member and the two third planar members to respective side portions of two second planar member by induction welding to form a composite intermediate product as a continuum of a third planar member, a second planar member, the first planar member, a second planar member and a third planar member, suitable for forming a tube-shaped composite fabrication member.

The disclosed method of making a composite fabrication member and the disclosed method of making a composite intermediate product may both have side portions of the first and third planar members overlap with side portions of the second planar members prior to induction welding. The second planar members may have thicknesses less than the thicknesses of the first and third planar members. Alternatively, the third planar members may have thicknesses less than the thicknesses of the first and second planar members.

The first and third planar members may be made from a material suitable for making a composite intermediate such as steel or aluminum or alloys thereof having different compositions. Alternatively the first and third planar members are made of a steel or aluminum or alloy thereof composition different from the second planar members.

Also disclosed is a method for making a tube-shaped fabrication member comprising the step of: providing in a coil a first planar member having a desired cross-sectional shape and a desired first set of properties suitable to form a first part of a tube-shaped composite fabrication member; providing in a coil a second planar member having a desired cross-sectional shape and a desired second set of properties different from the first set suitable to form a second part of a tube-shaped composite fabrication member; uncoiling and passing through accumulators the first planar member and the second planar member, the accumulators allowing sufficient delay to permit for welding of end portions of coils to enable continuous flow of first planar member, and second planar member; aligning side portions of first planar member and second planar member for attachment; attaching the first and second planar members together at first side portions adjacent a transition by induction welding to form a composite intermediate product as a continuum of the first and second planar members, suitable for forming into a tube-shaped composite fabrication member; and cold-forming the composite intermediate product to bend non-joined side portions of the first and second planar members and attaching together non-joined side portions of the first and second planar members by welding along said side portions to form a tube-shaped composite fabrication member.

In some embodiments, the step of cold-forming includes imparting bends in the first planar member, the first planar member having a thickness greater than the second planar member, adjacent the non-joined side portions and the adjacent transitions between the first planar member and the second planar members and therebetween to form a box-shaped tubular fabrication member. In alternative embodiments, the step of cold-forming includes imparting bends in the second planar member, the first planar member having a thickness greater than the second planar member, adjacent the non-joined side portions and the adjacent transitions between the first planar member and the second planar members and therebetween to form a box-shaped tubular fabrication member. In further embodiments, the step of cold-forming includes imparting a profile to the first and second planar members bringing the non-joined side portions of the first and second planar members together to form a curvilinear-shaped tubular fabrication member.

Also disclosed is a method for making a composite intermediate fabrication product comprising the steps of: providing in a coil a first planar member having a desired first set of mechanical properties and a desired cross-sectional shape, suitable to form a first part of a tube-shaped fabrication member; providing in a coil a second planar member having a desired second set of mechanical properties and a desired cross-sectional shape, suitable to form a second part of a tube-shaped fabrication member; providing in a coil a third planar member having a desired third set of mechanical properties and a desired cross-section shape, suitable to form a third part of a tube-shaped fabrication member; uncoiling and passing through accumulators the first planar member, the second planar member, and the third planar member, the accumulators allowing sufficient delay to permit for welding of end portions of coils to enable continuous flow of first planar member, second planar member, and third planar member; aligning a first side portion of the first planar member with a first side portion of the second planar member and aligning a second side portion of the second planar member with a first side portion of the third planar member for attachment; and, attaching the first and third planar members to the second planar member together at respective side portions by induction welding, forming a composite intermediate product, a continuum of the first planar member, second planar member, and third planar member.

Additionally disclosed is a method of forming a tube-shaped structural fabrication member comprising the steps of: providing in a coil a first planar member having a desired first set of mechanical properties and a desired cross-sectional shape, suitable to form a first part of a tube-shaped fabrication member; providing in a coil a second planar member having a desired second set of mechanical properties and a desired cross-sectional shape, suitable to form a second part of a tube-shaped fabrication member; providing in a coil a third planar member having a desired third set of mechanical properties and a desired cross-section shape, suitable to form a third part of a tube-shaped fabrication member; uncoiling and passing through accumulators the first planar member, the second planar member, and the third planar member, the accumulators allowing sufficient delay to permit for welding of end portions of coils to enable continuous flow of first planar member, second planar member, and third planar member; aligning a first side portion of the first planar member with a first side portion of the second planar member and aligning a second side portion of the second planar member with a first side portion of the third planar member for attachment; attaching the first and third planar members to the second planar member together at respective side portions by induction welding, forming a composite intermediate product, a continuum of first planar member, second planar member, and third planar member; cold-forming the composite intermediate product bringing the non-joined side portions of first and third planar members together and attaching adjacent side portions of the first and third planar members together by welding to form a tube-shaped composite fabrication member.

In some embodiments, the step of cold-forming may include imparting bends in the second planar member to form a U-shape with returns adjacent first and third planar members. In alternative embodiments, the step of cold-forming may impart bends in the second planar member to form a U-shape and bends in the first and third planar members adjacent the second planar member. In further embodiments, the step of cold-forming may impart a profile into the first, second and third planar members to form a curvilinear-shaped tubular fabrication member.

Also disclosed is a method of making a composite fabrication member comprising the steps of: providing in a coil a first planar member having a desired cross-sectional shape and a desired first set of mechanical properties suitable to form a first part of a fabrication member; providing in a coil a second planar member having a desired cross-sectional shape with a thickness less than the first planar member and a desired second set of mechanical properties different from the first planar member suitable to form a second part of a fabrication member; uncoiling and passing through accumulators the first planar member and the second planar member, the accumulators allowing sufficient delay to permit for welding of end portions of coils to enable continuous flow of first planar member and second planar member; aligning side portions of the first planar member and second planar for attachment; attaching the first planar member and second planar member together at side portions by induction welding to form a composite intermediate product as a continuum of first planar member and second planar member; and, cold-forming to form a composite fabrication member of a desired shape, such as L-shape, or tubular shape, or other desired shapes.

The method may also include where a lip is formed on the first planar member and second planar member to form a lipped L-shaped fabrication member. Furthermore, the method of making a composite fabrication member may comprise the additional step of welding two fabrication members together each of which are L-shaped to form a box-shaped tubular fabrication member.

The side portions of the first and second planar members may overlap prior to welding. The second planar member may form a light-weight web portion of the composite fabrication member, and the first planar member may form a flange portion of the composite fabrication member.

The first and second planar members may be formed from a material suitable for forming a composite fabrication member. Examples of which materials may include steel or aluminum or alloys thereof having different compositions. Alternatively, the first and second planar members may have the same composition.

Such disclosed methods may include the step of forming perforations, embossments or knurling in the composite intermediate product or the composite fabrication member.

Some embodiments of the present method may produce composite fabrication members of a desired cross-sectional shape at 300-500 ft/min, or up to 800 ft/min, or 1000 ft/min dependent, in part, on the size and desired cross-section shape. In other embodiments the present method may produce composite fabrication members of a desired cross-sectional shape in excess of 200 ft/min.

Presently disclosed is a system for forming a composite intermediate product by the herein disclosed methods. Additionally, presently disclosed is a system for forming a composite fabrication member by the herein disclosed methods.

The composite fabrication members have reduced cost in starting materials and reduced weight, and reducing associated transportation costs of raw materials, intermediary products, and finished products. Composite structural components formed by the present method are lighter, reducing the weight of the vehicles, reducing manufacturing expenses, and increasing fuel efficiency in operation of the vehicles. An L-shape formed from such methods shall have a more effective and efficient use of material, selecting the second planar member to provide a more effective and efficient amount of material used while having mechanical properties to provide the desired load-bearing capacity for the composite structural member, maintaining the composite fabrication member to required mechanical strength and design specifications.

The composite intermediate product and subsequent cold-formed structural fabrication member may be desirable in a number of industries. Such industries may include, but not be limited to, the building, automotive, piping, plumbing, gutter, mechanical, and oil & gas industries.

DETAILED DESCRIPTION OF THE DRAWINGS

Figure 1:
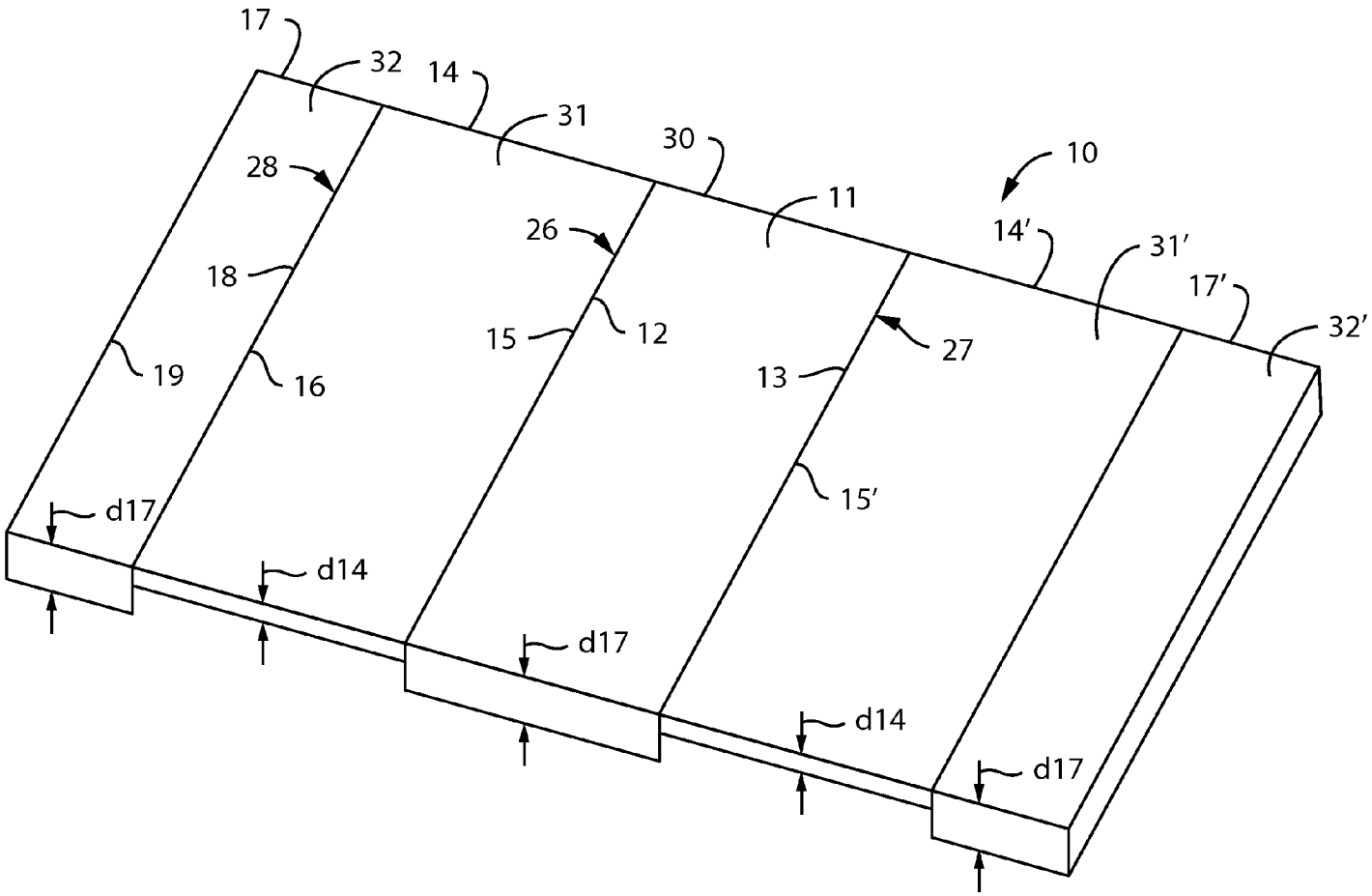
FIG. 1 is a perspective view of a composite intermediate product suitable to form a tube-shaped composite fabrication member.

Referring to FIG. 1. Illustrated is composite intermediate product 10 as a continuum of first, second, and third planar members. A first planar member 11 is provided having a first side 12 and a second side 13, and a desired first set of mechanical properties suitable to form a flange portion of a tube-shaped fabrication member, having been uncoiled from a coil of first planar member. Two second planar members 14 and 14' are provided having first sides 15 and 15' and second sides 16 and 16', and a desired second set of mechanical properties different from the first planar member 11 suitable to form web portions of a tube-shaped fabrication member, the second planar members 14 and 14' having. The first side 15 of one of the second planar members 14 adjacent the first side 12 of the first planar member 11, the first side 15' of the other second planar member 14' adjacent the second side 13 of the first planar member 11. Additionally, there is provided two third planar members 17 and 17' having first sides 18 and 18' and second sides 19 and 19', and a desired third set of mechanical properties suitable to form at least a portion of a flange of a tube-shaped fabrication member. The first side 18 of one of the third planar members 17 adjacent the second side 16 of one of the second planar members 14. The first side 18' of the other third planar member 17' adjacent the second side 16' of the other second planar member 14'.

As used herein, adjacent includes touching and overlapping. For example a first planar member adjacent a second planar member includes the first and second planar members touching at side portions and overlapping at side portions. A planar member as used herein is generally a substantially flat or curvilinear metal sheet of a desired cross-section. The planar members may be provided in coils, each planar member provided as a separate coil.

Furthermore, each planar member provided in coils formed from metal sheet may have a variety of coatings, such as coatings permissible by Table 1 of ASTM A1003/A1003M-12 Standard Specification for Steel Sheet, Carbon, Metallic and Nonmetallic Coated for Cold Formed Framing Members.

In some embodiments, the first planar member 11 may have the same mechanical properties as the third planar members 17 and 17'. Further, the second planar members 14 and 14' may have a set of mechanical properties, different from the mechanical properties of the first and third planar members. In other embodiments, the mechanical properties of the second planar members 14 and 14' may be the same as the mechanical properties of the first planar member 11 and/or the third planar members 17 and 17'.

The first planar member 11 has a selected thickness $d_{11}$, the second planar members 14 and 14' have a selected thickness $d_{14}$, generally thinner than the thickness $d_{11}$. The third planar members 17 and 17', have a selected thickness $d_{17}$, generally of the same thickness $d_{11}$ as the first planar member 11, but the thickness $d_{17}$ may be different than thickness $d_{11}$. Generally, the second planar members 14 and 14', having thicknesses $d_{14}$ less than the thicknesses of the first and third planar members, $d_{11}$ and $d_{17}$. Alternatively, the third planar members 17 and 17' may have thicknesses less than the thicknesses of the first and second planar members.

Each planar member may be made from any suitable material to form a composite fabrication member having a desired shape. Examples of which may be metal strip or sheet, such as steel, aluminum, other metal alloys thereof, or composite metal strips. Each planar member may be of the same composition. In other embodiments each planar member or some of the planar members may have different compositions and mechanical properties. In further embodiments the first and third planar members are made of a steel or aluminum or alloys thereof composition being different composition from the steel or aluminum or alloys thereof composition of the second planar members.

A composite intermediate product 10 as a continuum of first, second, and third planar members may be formed by attaching side portions the first planar member 11 and the two third planar members 17 and 17' to respective side portions of the second planar members 14 and 14' by welding to form a composite intermediate product 10 as a continuum of a third planar member 17, a second planar member 14, the first planar member 11, a second planar member 14' and a third planar member 17', suitable for forming a tube-shaped composite fabrication member. Specifically, the first side portion 12 of the first planar member may be attached to the first side portion 15 of the second planar member 14 and the second side portion 16 of the second planar member 14 may be attached to the first side portion 18 of the third planar member 17. Additionally, the second side portion 13 of the first planar member 14 may be attached to the first side 15' of the other second planar member 14', and the second side portion 16' of the other second planar member 14' may be attached to the first side portion 18' of the other third planar member 17'. Thereby forming a composite intermediate product 10, as a continuum of a third planar member, a second planar member, the first planar member, a second planar member, and a third planar member, adapted to be used in the formation of a tube-shaped composite fabrication member meeting customer specifications.

The attaching of side portions may be performed by continuous induction welding. In other embodiments, attaching of side portions may be performed by discrete induction welding at discrete intervals along respective side portions at each weld site. Induction welding is where a conductive material (metal) passes through an electromagnetic field producing localized currents which heat the 2 edges of material through resistance and hysteresis to the point at which they can be fused. The electromagnetic field can be produced by passing an electrical current through a coil of conductive material or by inducing currents though contacts contact applied to the 2 material edges. As used herein, "induction welding," as used herein, may also include high frequency contact welding where weld current is transferred to the formed steel through contacts that ride on the strip. In high frequency contact welding the welding current is applied directly to a workpiece, such as a tube.

After forming the composite intermediate product 10, the welds along weld sites 24 and 25 may undergo a post-welding coating process whereby a coating, permissible by various ASTM standards, may be applied to the weld site to protect the weld from corrosion. Such process may be referred to as "metallizing welds."

In some embodiments the induction welding is adapted to attach side portions of the planar members at a rate of 300-500 ft/min. Alternatively the welding method may be adapted to attach side portions of the planar members at a rate in excess of 200 ft/min, 800 ft/min or 1,000 ft/min. Side portions of the first and third planar members, 11, 17 and 17', respectively, may overlap with side portions of the second planar members 14 and 14' prior to welding. For example, the first side portions 12 and second side portions 13 of the first planar member 11 may extend over and beyond the first side portions 15 and 15' of the second planar members 14 and 14', respectively. Similarly, the first side portions 18 and 18' of the third planar members 17 and 17', respectively, may extend beyond the second side portions 16 and 16' of the second planar members 14 and 14', respectively. When welded, weld sites 26, 27, 28, and 29 are formed, amalgamating the material at side portions of each adjacent planar member.

In alternative embodiments, the planar members may be connected by butt welding adjacent planar members together. In such embodiments, the side portions of adjacent planar members abut. For example, the second side portion 16 of the second planar member 14 may be positioned adjacent and abutting the first side portion 18 of the third planar member 17. The second planar member 14 and the third planar member 17 may then be butt welded together, at the weld site 28, to form a contiguous composite intermediate product 10 for forming a tube-shaped composite fabrication member. Other attachments of planar members may be performed in a similar manner. Welding by butt welding may require the additional step of adding a flux material to provide sufficient material to form an attachment between adjacent planar members. Similarly, the selected method of butt-welding by induction welding may be adapted to attach side portions of the planar members together in excess of 200 ft/min, 800 ft/min, or 1,000 ft/min. In some embodiments the selected method of but-welding may be adapted to attach side portions of the planar members together at a rate of between 300 ft/min and 500 ft/min.

The composite intermediate product 10, a continuum of strips comprising first, second, and third planar members is a continuous strip of material of metal, with attachment by welding, at the weld sites 26, 27, 28, and 29, merging the second planar members 14 and 14' with the first planar member 11 and the third planar members 17 and 17' to form a strip of material having a contiguous cross-section formed as a continuum of the first and second and third planar members. The composite strip, comprising the composite intermediate product 10 having different cross-sectional thicknesses, $d_{11}$, $d_{14}$, and $d_{17}$ across its width.

The strip, comprising the composite intermediate product 10, may have one surface on a substantial plane, with the top surfaces of each of the planer members positioned flush with one another, and with the bottom surface of the strip undulating, across its width, upon the transition between the first planar member 11 and the second planar members 14 and 14', and upon the transition between the second planar members 14 and 14' with the third planar members 17 and 17', providing for a composite intermediate product 10 with a stepwise bottom surface. In some embodiments, the second planar members 14 and 14', having a thickness $d_{14}$ less than the thickness $d_{11}$ of the first planar member 11 and less than the thickness $d_{17}$ of the third planar members 17 and 17', may be positioned, relative to the other planar members, such that the top surfaces 30, 31 and 31', and 32 and 32' of all the planar members are flush. Consequently, the bottom surface of the second planar members 14 will be inward, vertically, from the bottom surfaces of the other planar members. Thus, a composite intermediate product 10, a continuum of first, second, and third planar members, is formed having a substantially flat top surface, and a stepwise bottom surface, across its width, the bottom surface of the second planar member recessed relative to the bottom surface of the first and third planar members.

Alternatively, by way of example, the second planar members 14 and 14', may be positioned vertically at any position along the thickness $d_{11}$ of the first planar member 11, and vertically at any position along the thickness $d_{17}$ of the third planar members 17 and 17'. In such embodiments, both the top and bottom surfaces of the composite intermediate product 10 may be stepwise, across its width, from the transitions between the first, second, and third planar members.

The strip, comprising the composite planar member 10, having different thicknesses $d_{11}$, $d_{14}$ and $d_{17}$ across its width may be coiled by a coiler (see FIG. 10*a*) and transported as an intermediate product to a separate forming facility for forming into a composite fabrication member. Such facility may be a cold-forming facility, such as that shown in FIG. 14, and discussed below, adapted to cold-form with roll sets the composite intermediate product, a continuum of multiple planar members, into a composite fabrication member. Alternatively, such facilities may be a hot-rolling facility, where the facility heats the strip, comprising the composite intermediate product 10, and hot-rolls the strip to a desired cross-sectional shape.

Figure 2:
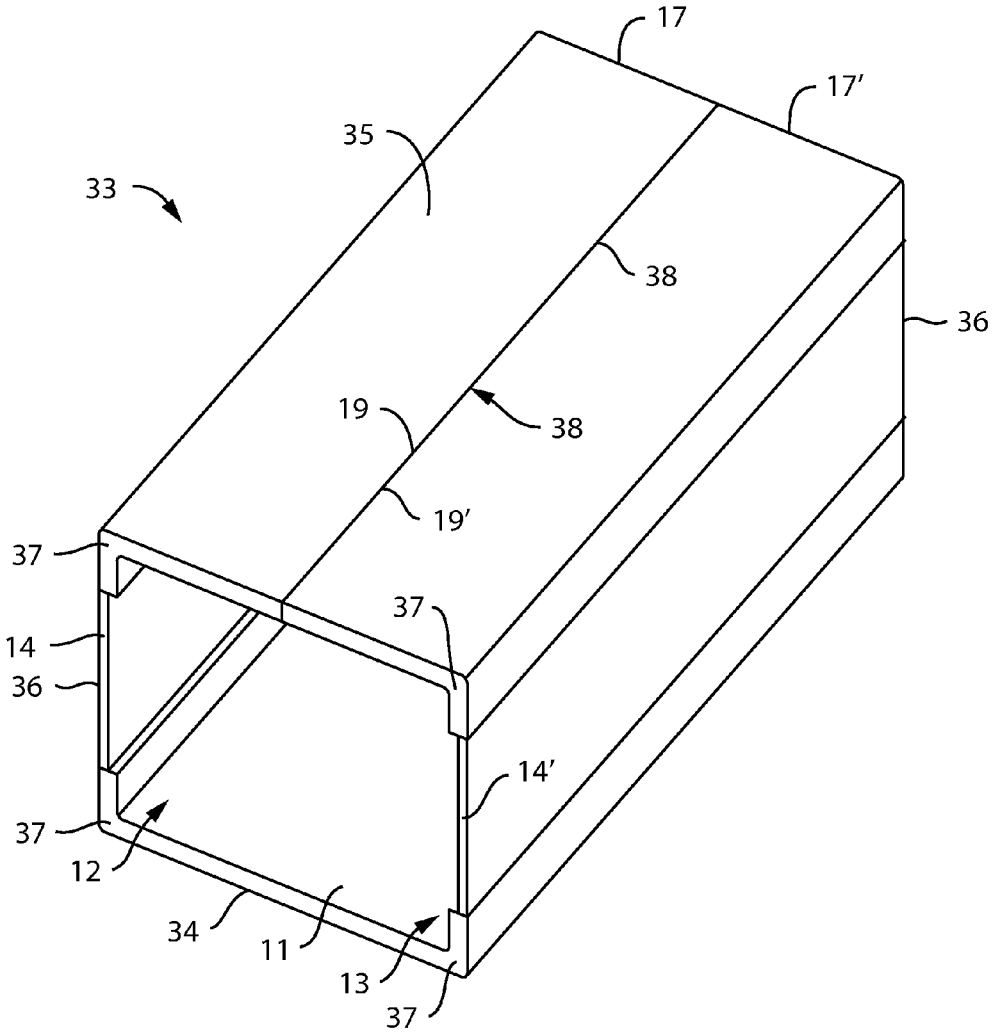
FIG. 2 is a perspective view of a tube-shaped composite fabrication member formed from the composite intermediate product shown in FIG. 1.
Figure 3:
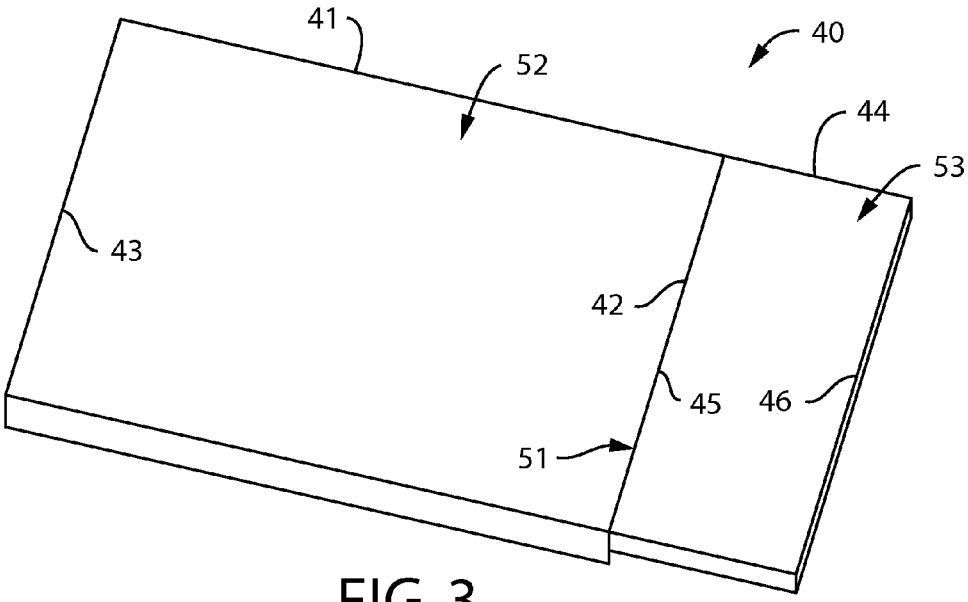
FIG. 3 is a perspective view of a second embodiment of a composite intermediate product suitable to form a tube-shaped composite fabrication member.
Figure 4:
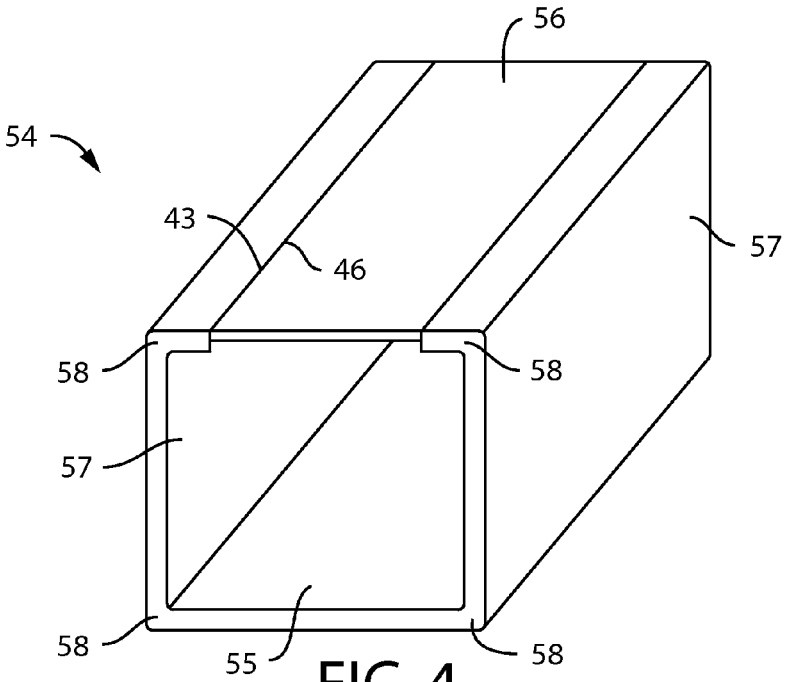
FIG. 4 is a perspective view of a tube-shaped composite fabrication member formed from the composite intermediate product shown in FIG. 3.

Referring to FIG. 2. Illustrated is a tube-shaped fabrication member 33 formed by cold-forming the composite intermediate product 10 to form a composite fabrication member 33 of a tube-shape, where the first planar member 11 is one flange portion 24, the two second planar members 14 and 14' are two web portions 36 and 36', and the two third planar members 17 and 17' are each a portion of a second flange portion 35 of the tube-shaped composite fabrication member 33. The tube-shaped composite fabrication member 33 may formed from cold-forming the composite intermediate product 10 with the first planar member 11 forming a flange portion 34, the second planar members 14 and 14' forming web portions 36, and the third planar members 17 and 17' forming a flange portion 35 of the tube-shaped composite fabrication member 33. The composite intermediate product 10, a continuum of first, second, and third planar member shown in FIG. 1, has been shaped, by cold-forming, or otherwise, to form a tube-shaped composite fabrication member 33. The step of cold-forming may impart bends 37 in the first and third planar members adjacent transitions between the first and second planar members and the second and third planar members to form a box-shaped tubular fabrication member. Such bends 37 may be formed at or adjacent the first side portion 12 and second side portion 13 of the first planar member 11, and the first side portions 18 and 18' of the third planar members 17 and 17'. In further embodiments, the composite fabrication member may require the bends 37 to be situated in the web portions, the cold-forming apparatus may be adapted to put the bends 37 into the web portion to form a box-shaped composite fabrication member. In other embodiments the step of cold-forming imparts a profile into the first, second, and third planar members to form a curvilinear tubular fabrication member.

The cold-forming apparatus may be coupled with a welding apparatus for attaching the two third planar members 17 and 17' together by induction welding to form a continuous flange 35 of the tube-shaped composite structural frame member 33. Alternatively, the welding apparatus for connecting the second sides 19 and 19' together may be separate from the cold-forming apparatus. Induction welds are dapted to attach the two third planar members 17 and 17' together to form a continuous flange 35 of the tube-shaped composite structural frame member 33. The second side portions 19 and 19' of the third planar members 17 and 17' may overlap prior to attaching by induction welding, forming a welding site 38. Third planar members 17 and 17', which cumulatively form a flange portion 35 of the tube-shaped fabrication member 33, where the second side portions 19 and 19' overlap, may each have a width wider than one half of the width of the first planar member 11. In other embodiments, second side portions 19 and 19' of the third planar members 17 and 17', respectively, may abut each other, having no overlap. Such third planar members 17 and 17' may have a width equal to or less than one half of the width of the first planar member 11, and may be attached by induction welding at the weld site 38. Where the second side portions 19 and 19' of the third planar members 17 and 17', respectively, abut each other, having no overlap, a flux may be required during attachment by induction welding, to form the attachment without a reduction in the thickness of the side portions 19 and 19'. In any embodiment, the welds at the welding site 38 between the third planar members 17 and 17' may be continuous or discrete, as described above. The induction welding may be adapted to attach by induction welding the second side portions 19 and 19' of the third planar members 17 and 17', respectively.

The step of attaching the first planar member 11 and third planar members 17 and 17' to the second planar members 14 and 14' may be performed with the step of cold-forming to form a composite fabrication member 33 having a tube-shape. Additionally, the step of attaching second side portions 19 and 19' of the third planar members 17 and 17', respectively, together to form a second flange portion 35, may be performed with the step of attaching the planar members together and step of cold-forming to form a composite fabrication member 33 having a tube-shape.

In further embodiments, the composite intermediate product, as a continuum of first and second planar members, suitable to form a tube-shaped fabrication member, may be cold-formed to form a tube-shaped fabrication member, with the thicker first planar member oriented above the thinner second planar member, such that the top portion of the tube-shaped fabrication member may withstand compression forces and the bottom portion may withstand tension forces. Additionally, the composite intermediate product may be cold-formed such that the first, second, and/or third planar members are rounded, to form a tube-shaped fabrication member having a rounded cross-section. Such tube-shaped fabrication members may be formed from two, three, or four planar members. In other embodiments, tube-shaped fabrication members may be formed from any desired number of planar members to form a more effective and efficient tube-shaped fabrication member.

The tube-shaped composite fabrication member formed by the presently disclosed method may have a square shape, rectangular, round shape, oval shape, or polygonal shape, as desired, to meet customer specification. Each planar member provided in the method may be flat or curved to meet the desired characteristics of the composite intermediate product suitable to form into a tube-shaped composite fabrication member having a desired cross-sectional shape and a desired set of mechanical properties. A curved planar member may have particular benefit during the cold-forming process, allowing particular forces to be imparted onto the plurality of planar members otherwise not available when cold-forming flat planar members. Flat planar members may have the advantage of being easier to transport and of being processed by existing cold-forming mills, and particularly suited for imparting a different set of forces when cold-forming. A polygonal-shaped, round-shaped, or oval-shaped composite fabrication member may be adapted to be used as a pipe for transportation of fluids, including liquids and gasses, with round and oval-shaped, particularly suited to the transport of fluids under pressure.

Additionally, knurling, perforations, and/or embossments may be formed in the composite intermediate product 10 and/or the tube-shaped fabrication member 33.

Referring to FIG. 2. Illustrated is a composite intermediate product 40 comprised of a first planar member 41 and a second planar member 44. A first planar member 41 having a first side portion 42 and a second side portion 43 and a desired cross-sectional shape and a desired first set of properties suitable to form a first part of a tube-shaped composite fabrication member, the first planar member 41 provided in a coil and uncoiled by a coiler. A second planar member 44 is provided having a first side portion 45 and a second side portion 46 a desired cross-sectional shape and a desired second set of properties different from the first set suitable to form a second part of a tube-shaped composite fabrication member, the second planar member 44 provided in a coil and uncoiled by a coiler. The first planar member 41 and second planar member 44 may be uncoiled and aligned at side portions for attachment. The first planar member 41 and the second planar member 44 may be attached together at side portions 42 and 43 of the first planar member 41 and first side portions of the second planar member 46 and 46' at a transition 51, or weld site, by welding to form a composite intermediate product 40 as a continuum of first and second planar members, suitable for forming into a tube-shaped composite fabrication member.

Similarly to the embodiment illustrated in FIG. 1, each planar member may have a thickness. The thickness $d_{41}$ of the first planar member 41 may be greater than the thickness $d_{44}$ of the second planar member 44. Alternatively the thicknesses may be the same. The composite intermediate product 40 may have a stepwise top and bottom surface or, as shown, the composite intermediate product 40 may have a planar surface and a step-wise second surface.

A tube-shaped composite fabrication member 54 may be formed from the composite intermediate product 40 by cold-forming. The composite intermediate product 40 may be cold-formed to bend non-joined side portions of the first planar member 41 and second planar member 44 and attaching together non-joined side portions of the first planar member 41 and second planar member 44 to form a tube-shaped composite fabrication member 54. Bends 58 may be imparted during cold-forming into the first planar member 41, the first planar member 41 having a thickness greater than the second planar member 44, adjacent the non-joined side portion 42 of the first planar member 41, adjacent the transition between the first planar member 41 and second planar member 44 at the second side portion 43 of the first planar member 41, and therebetween in the first planar member 41, to form a box-shaped tubular fabrication member 54. In alternative embodiments bends 58 may be imparted during cold-forming in the second planar member 44, the first planar member 41 having a thickness greater than the second planar member 44, the bends 38 adjacent the non-joined side portions 46 of the second planar member 44, and the transition between the first planar member 41 and second planar member 44, at the first side portion 45 of the second planar member 44, and therebetween in the second planar member 44, to form a box-shaped tubular fabrication member 54.

In alternative embodiments the composite intermediate product 40 may be cold formed and a profile may be imparted into the first planar member 41 and the second planar member 44 bringing the non-joined side portions of the first and second planar members together to form a curvilinear tubular fabrication member.

Figure 5:
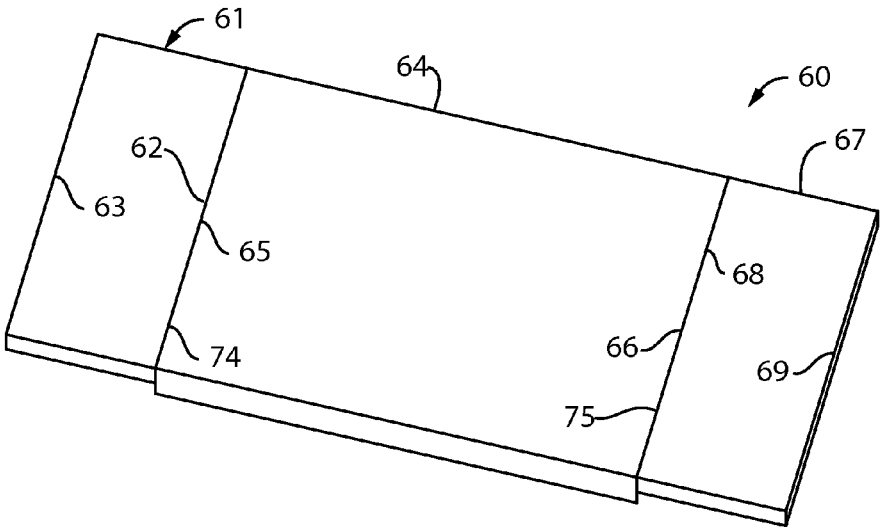
FIG. 5 is a perspective view of a third embodiment of a composite intermediate product suitable to form a tube-shaped composite fabrication member.

Referring to FIG. 5. Illustrated is a composite intermediate member 60 comprised of a first planar member 61 and second planar member 64 and a third planar member 67. A first planar member 61 may be provided in a coil having a desired first set of mechanical properties and a desired cross-sectional shape, suitable to form a first part of a tube-shaped fabrication member. A second planar member 64 may be provided in a coil having a desired second set of mechanical properties and a desired cross-sectional shape, suitable to form a second part of a tube-shaped fabrication member. A third planar member 67 is provided in a coil having a desired third set of mechanical properties and a desired cross-sectional shape, suitable to form a third part of a tube-shaped fabrication member. The first planar member 61, second planar member 64, and third planar member 67, provided in coils, may be uncoiled and respective side portions of the planar members aligned for attachment. The first planar member 61 and the third planar member 67 may be attached to the second planar member 64 at respective side portions by induction welding, forming a composite intermediate product 60, a continuum of first planar member 61, second planar member 64, and third planar member 67. The thicknesses $d_{61}$ and $d_{67}$ of the first planar member 61 and third planar member 67 may be less than the thickness $d_{64}$ of the second planar member 64.

Figure 6:
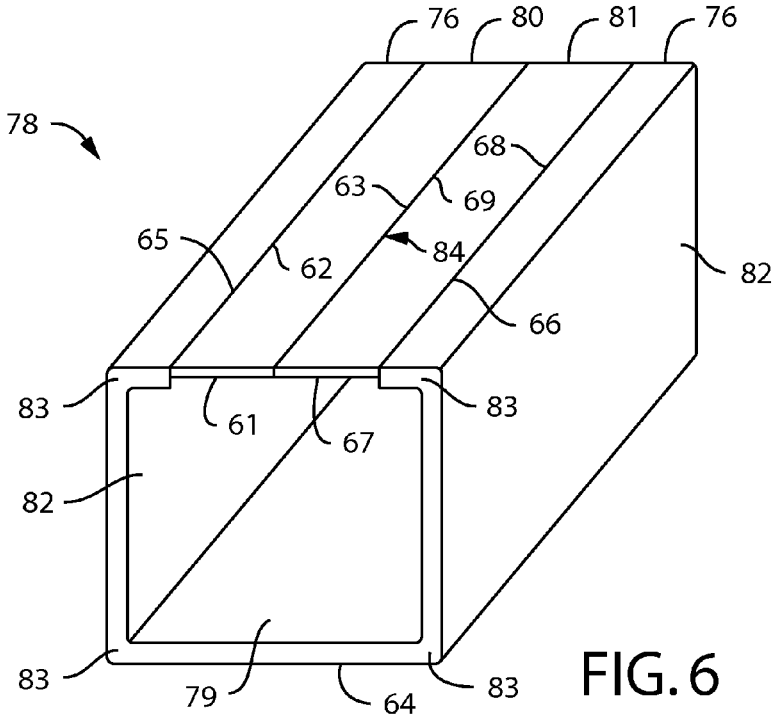
FIG. 6 is a perspective view of a tube-shaped composite fabrication member formed from the composite intermediate product shown in FIG. 5.

Referring to FIG. 6. A tube-shaped composite fabrication member 78 may be formed by cold-forming the composite intermediate product 60 bringing the non-joined side portion 63 of the first planar member 61 and the non-joined side portion 69 of the third planar member 67 together and attaching adjacent side portions together by induction welding to form a tube-shaped composite fabrication member 78. Such induction welding may be adapted to attach side portions of the planar members at a rate in excess of 200 ft/min, 300 ft/min, 800 ft/min, or 1,000 ft/min. Bends 83 may be imparted in the second planar member 64 to form a U-shape with returns 76, the returns adjacent the first planar member 61 and second planar member 67. In alternative embodiments, the step of cold-forming imparts bends in the second planar member 64 to form a U-shape and bends in the first side portion 62 of the first planar member 61 and the first side portion 68 of the third planar member 67 adjacent the second planar member 64. In further embodiments a profile may be imparted by cold-forming in the first, second, and third planar members to form a curvilinear tubular fabrication member.

Similarly to the embodiments illustrated in previous figures, the composite intermediate product 60 may have one flat planar surface and one stepwise surface, where the thicknesses $d_{61}$ and $d_{67}$ of the first and third planar members, respectively, are less than the thickness $d_{64}$ of the second planar member 64. Alternatively, the composite intermediate product may have two stepwise surfaces where the first and third planar members having thicknesses less than the second planar members are positioned off-set with the second planar member.

Figure 7:
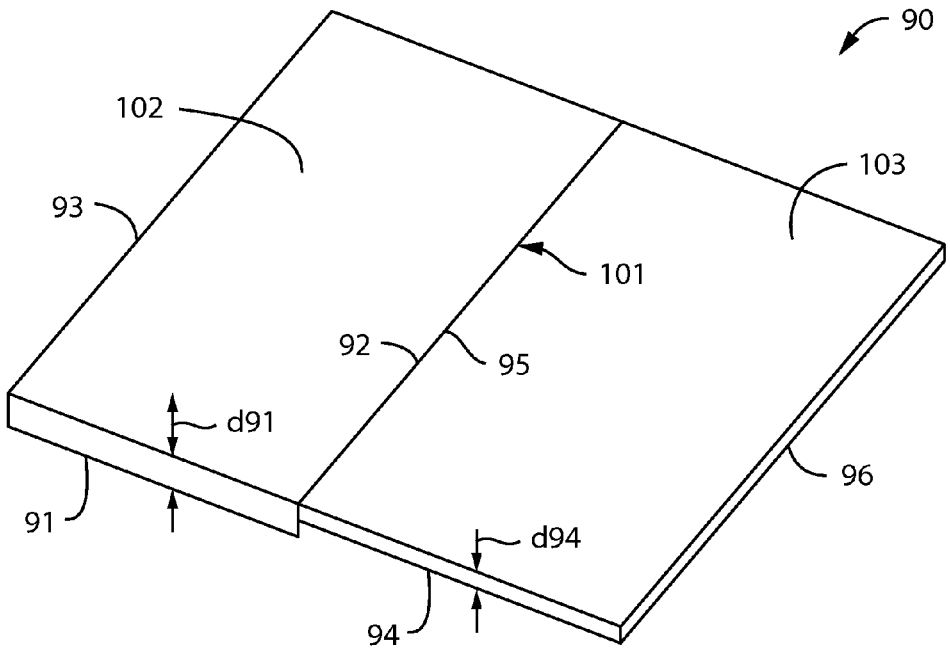
FIG. 7 is a perspective view of a composite intermediate product suitable for forming a composite fabrication member.

Referring to FIG. 7, illustrated is composite intermediate product 90 comprised of a first planar member 91 having a first side portion 92 and a second side portion 93, and a second planar member 94 having a first side portion 95 and a second side portion 96, the first side portion 95 of the second planar member 94 adjacent the first side portion 92 of the first planar member 91. The first planar member 91 and the second planar member 94 may be provided in coils. The coils of first planar member 91 and second planar member 94 may be uncoiled and respective side portions aligned for attachment. A first planar member 91 is provided having a desired cross-sectional shape and a desired first set of mechanical properties, suitable to form a first part of a composite fabrication member. A second planar member 94 is provided having a desired cross-sectional shape and a desired second set of mechanical properties different from the first planar member 91, suitable to form a second part of a composite fabrication member. In other embodiments, the mechanical properties of the second planar member 94 may be the same as the mechanical properties of the first planar member 91.

In all embodiments, each planar member may be made from any material suitable for a composite fabrication member. For example, each planar member may be made from metal sheet or strip, such as steel, aluminum, alloys thereof, or other metal alloys, or composite metal strips. The second planar member 94 may have a thickness $d_{94}$ less than the thickness $d_{91}$ of the first planar member 91, such that the second planar member 94 forms a web portion of a composite fabrication member (see FIG. 2) having a web thinner than the flanges, providing a structural framing member having a lightweight web portion. Alternatively, the thickness $d_{94}$ may be the same as, or greater than, the thickness $d_{91}$. A lightweight web portion provides for a more efficient and effective composite fabrication member.

The first planar member 91 may be attached to the second planar member 94 at side portions by welding to form a composite intermediate product 90 as a continuum of the first planar member 91 and second planar member 94. Methods of welding may be continuous induction welding. Alternatively, methods of welding may be discrete induction welding forming welds at discrete intervals along the length of side portions of the planar members at the weld site 101. Such methods of induction welding may be adapted to attach side portions of planar members at a rate in excess of 200 ft/min, 300 ft/min, 500 ft/min, 800 ft/min, or 1,000 ft/min. The first side portion 92 of the first planar member 91 may extend over and beyond the first side portion 95 of the second planar member 94, where the first side portion 92 of the first planar member 91 is welded with the first side portion 95 of the second planar member 94 forming a weld site 101.

The resulting composite intermediate product 101, being a continuum of the first planar members 91 and second planar members 94, is a continuous component of material, usually metal, with welding at the weld site 101 attaching the first planar member 91 with the second planar member 94 to form a composite intermediate product 101 having a contiguous cross-section of differing thicknesses $d_{91}$ and $d_{94}$ formed from the first and second planar members.

The composite intermediate product 90, as a continuum of the first and second planar members, may have one surface on a constant plane. For example, the second planar member 94, having a thickness $d_{94}$ less than the thickness $d_{91}$ of the first planar member 91, may be positioned such that the top surface 103 of the second planar member is flush with the top surface 102 of the first planar member 91. Consequently, the bottom surface of the second planar member 94 will be stepwise, inward, from the bottom surface of the first planar member 91, providing for a composite intermediate product 90 having a flat, planar, top surface and an undulating bottom surface, across its width.

In alternative embodiments, the second planar member 94, having a thickness $d_{94}$ less than the thickness $d_{91}$ of the first planar member 91, may be positioned at any position on the thickness $d_{91}$ of the first planar member 91. In such embodiments, both the top and bottom surfaces of the composite intermediate product 90 may be stepwise, across its width, with the transitions between the first and second planar members.

The composite intermediate product 90 may be cold-formed to form a composite fabrication member 104 of a desired shape. The second planar member 94 may be selected to provide a desired lightweight web member for the composite fabrication member 104. The first planar members 01, being thicker and having different mechanical properties from the second planar member 94, usually forming flange portions of the fabrication member 104. While the mechanical properties of the first planar member 91 may differ from the mechanical properties of the second planar member 94, the planar members may be of the same composition. Alternatively, the composition of the second planar member 94, usually forming the webs of the composite fabrication member 104, may be different from the first planar member 91. The first planar member 91 and the second planar member 94 may be made of steel, or aluminum, or alloys thereof, having different, or the same, compositions.

The strip, comprising the composite planar member 90, having different thicknesses $d_{91}$ and $d_{94}$ across its width may be coiled by a coiler (see FIGS. 10*a* and 10*b*) and transported as an intermediate product to a separate forming facility for forming into a composite fabrication member. Such facility may be a cold-forming facility, such as that shown in FIG. 15, and discussed below, adapted to cold-form with roll sets the composite intermediate product, a continuum of multiple planar members, into a composite fabrication member. Alternatively, such facilities may be a hot-rolling facility, where the facility heats the strip, comprising the composite intermediate product 90, and hot-rolls the strip to a desired cross-sectional shape.

In some embodiments, the step of cold-forming the strip, comprising of composite intermediate product 90 as a continuum of first planar member 91 and second planar member 94, having different thicknesses $d_{91}$ and $d_{94}$, across its width, may be performed with the step of attaching the first and second planar members together at respective side portions by welding to form a composite fabrication member having a desired cross-sectional shape. Alternatively, such cold forming may take place at a different time and location.

Figure 8A:
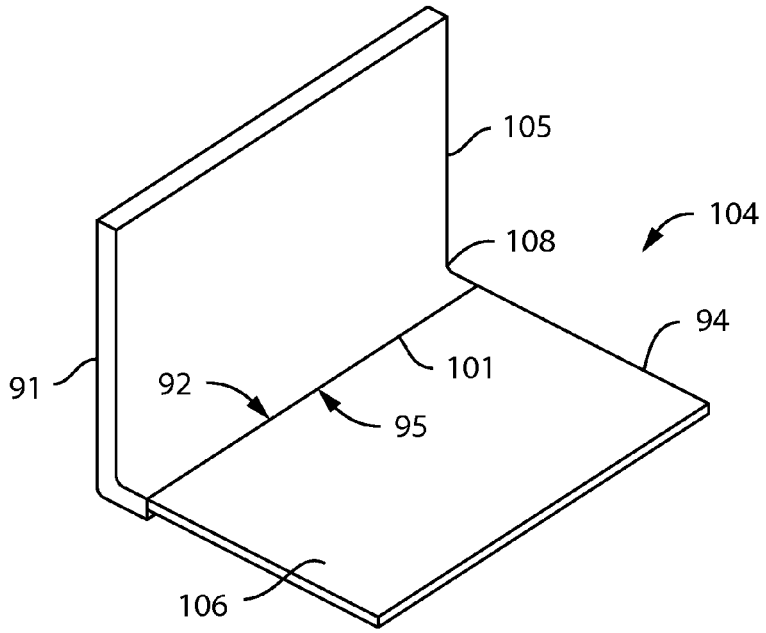
FIG. 8*a* is a perspective view of a composite fabrication member formed from the intermediate product shown in FIG. 7.

Referring now to FIG. 8*a*, illustrated is a composite fabrication member 104 formed by cold-forming the composite intermediate product 90 to form a composite fabrication member 104 having an L-shape, with first planar member 91*a* flange 105 of the composite fabrication member 104 and second planar member 94 a web 106 of the fabrication member 104. The composite intermediate product 90, a continuum of first and second planar members, shown in FIG. 7, is shaped, by cold-forming, or otherwise, to form a composite fabrication member 104 having an L-shape. The bend 108, formed by the cold-forming process, may be situated at the first side portion 92 of the first planar member 91, forming the flange 105 of the composite fabrication member 104 having an L-shape. By having the bend 108 in the first side portion 92 of the first planar member 91 ensures that the flange 105 extends along all of the thicker portion of the composite fabrication member 104 having an L-shape. In other embodiments, the bend 108 may be positioned along the weld site 101, the transition between the first planar member 91 and the second planar member 94. In further embodiments, the bend 108 may be positioned in the second planar member 94, at the first side portion 96, or elsewhere.

Figure 8B:
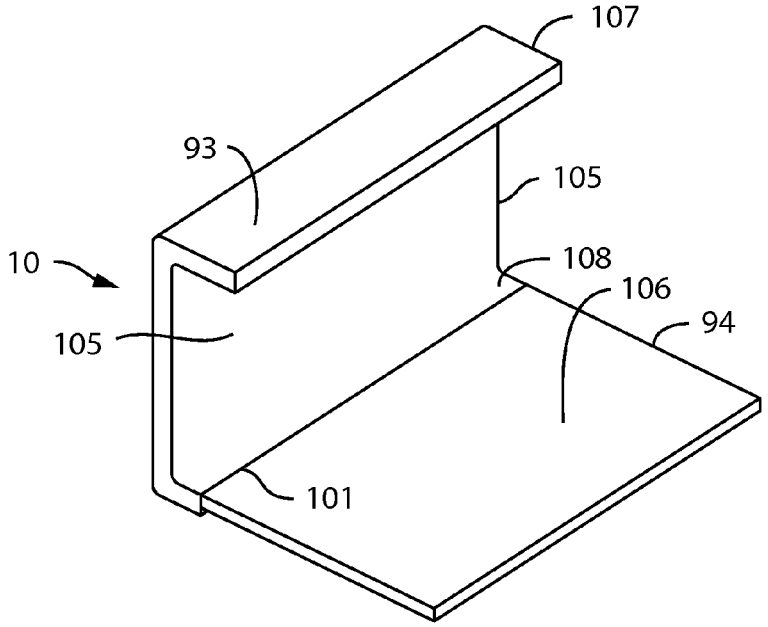
FIG. 8*b* is a perspective view of a lipped composite fabrication member formed from the intermediate product shown in FIG. 7.

FIG. 8*b* illustrates an alternative embodiment of a composite fabrication member 109 having an L-shape, where a lip 107 is formed on the first planar member 91 and second planar member 94 to form a lipped L-shaped fabrication member 109. In some embodiments, the lip is formed adjacent the second side portion 93 of the first planar member 91, opposite the bend 108 adjacent the first side portion 92 of the first planar member 91, to form a lipped L-shaped member of the first and second planar members. In some embodiments, the lip 107 at the second side portion 93 of the first planar member 91 may be formed to extend in the opposite direction to the first side portion 92 of the first planar member 91, thereby forming a lipped L-shape member of the first and second planar members, where the lip extends in the opposite direction to the second planar member 94. In further embodiments, the lip 107 may be formed at any angle relative to the main portion 110 of the first planar member 91 to form a composite fabrication member 104 having a desired cross-sectional shape and mechanical properties. For example, an angled lip may be cold-formed at the second side portion 93 of the first planar member 91 to form an r-shaped member of the first planar member 91. Similar lips may be formed, as desired, in the second side portion 96 of the second planar member 94. a lip may be formed in the second edge portion 96 of the second planar member 94 at any angle relative to the main portion 111 of the second planar member 94.

In any embodiment, the first planar member 91 may overlap with the second planar member 94 with first side portions 92 of the first planar member 91 extending to or beyond first side portions 95 of the second planar member 94.

The first planar members 91 and second planar members 94 may be selected to have properties for providing a more effective and efficient amount of material used to form the composite fabrication member 104, while providing desired mechanical properties of the composite fabrication member 104. The second planar member 94 may form a light-weight web portion of the composite fabrication member 104.

In embodiments, perforations, knurling, or embossments may be formed in the composite intermediate product or the composite fabrication member by cold-forming or otherwise.

Figure 9:
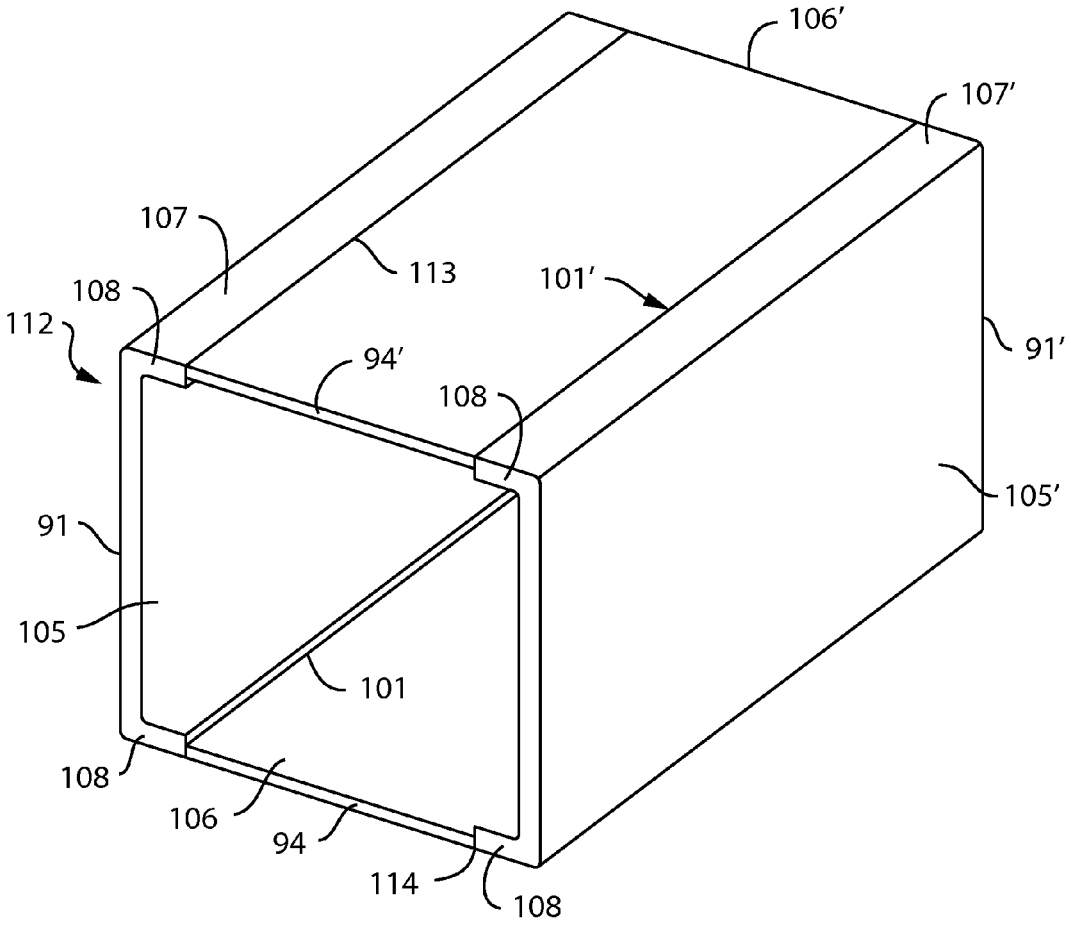
FIG. 9 is a perspective view of a tube-shaped composite fabrication member formed from lipped composite fabrication members each having a lipped L-shape, with first planar members attached to second planar members.

FIG. 9 illustrates a tube-shaped composite fabrication member 112 formed from two composite fabrication members 109, 109' having a lipped L-shape. The tube-shaped composite fabrication member 112 may be formed by the additional step of attaching, by welding, two fabrication members 109 and 109' together each of which are L-shaped to form a box-shaped tubular fabrication member 112. In some embodiments the box-shaped tubular fabrication member 112 may have webs 106 and 106' connecting to flanges 105' and 105, respectively. Such tube-shaped composite fabrication members 112 formed from two composite fabrication members 109, 109' having a lipped L-shape may be formed with the step of cold-forming the composite planar member 90. Two cold-forming apparatuses may be utilized to make the two composite structural members 109, 109' having an L-shape simultaneously. These continuous strips of composite structural members 109, 109' having an L-shape may then be brought together and attached together by induction welding, the web 106 of a first lipped L-shaped composite fabrication member 109 welded to the flange 105' of the second lipped L-shaped composite fabrication member 109' along weld line 113, and the flange 105 of the first lipped L-shaped composite fabrication member 109 welded to the web 106' of the second L-shaped composite fabrication member 109' along weld site 114. In alternative embodiments, there may be a single cold-forming apparatus forming composite fabrication members having a lipped L-shape 109 in discrete sections. Two discrete sections may then be brought together at a welding facility for forming into a tube-shape composite fabrication member 112. The cold-forming and welding facilities for making a tube-shaped fabrication member 112 may be separate or located proximately to each other. Forming the tube-shaped fabrication member 112 may be continuous, having a shear, or other cutting means, adapted to cut the tube-shaped fabrication members 32 to a desired length after forming. In other embodiments, the forming of the tube-shaped structural framing member 32 may be discrete, having a shear, or other cutting means, to cut lipped L-shaped composite fabrication members 29 to a desired length before welding the two cut lipped L-shaped composite fabrication members 29 and 29' together to form a tube-shaped composite fabrication member 32.

In all embodiments the cold-forming facility and welding facility for making tube-shaped composite fabrication members may be separate from the welding line for making the composite intermediate product, such the composite intermediate product may be made at one location and distributed to other locations for processing to form fabrication members having a desired cross-section shape and a desired set of mechanical properties. In alternative embodiments all processes may be performed in proximate locations such that raw material in the form of coils of planar members may be formed into composite fabrication members in the same or in proximate locations.

Figure 10A:
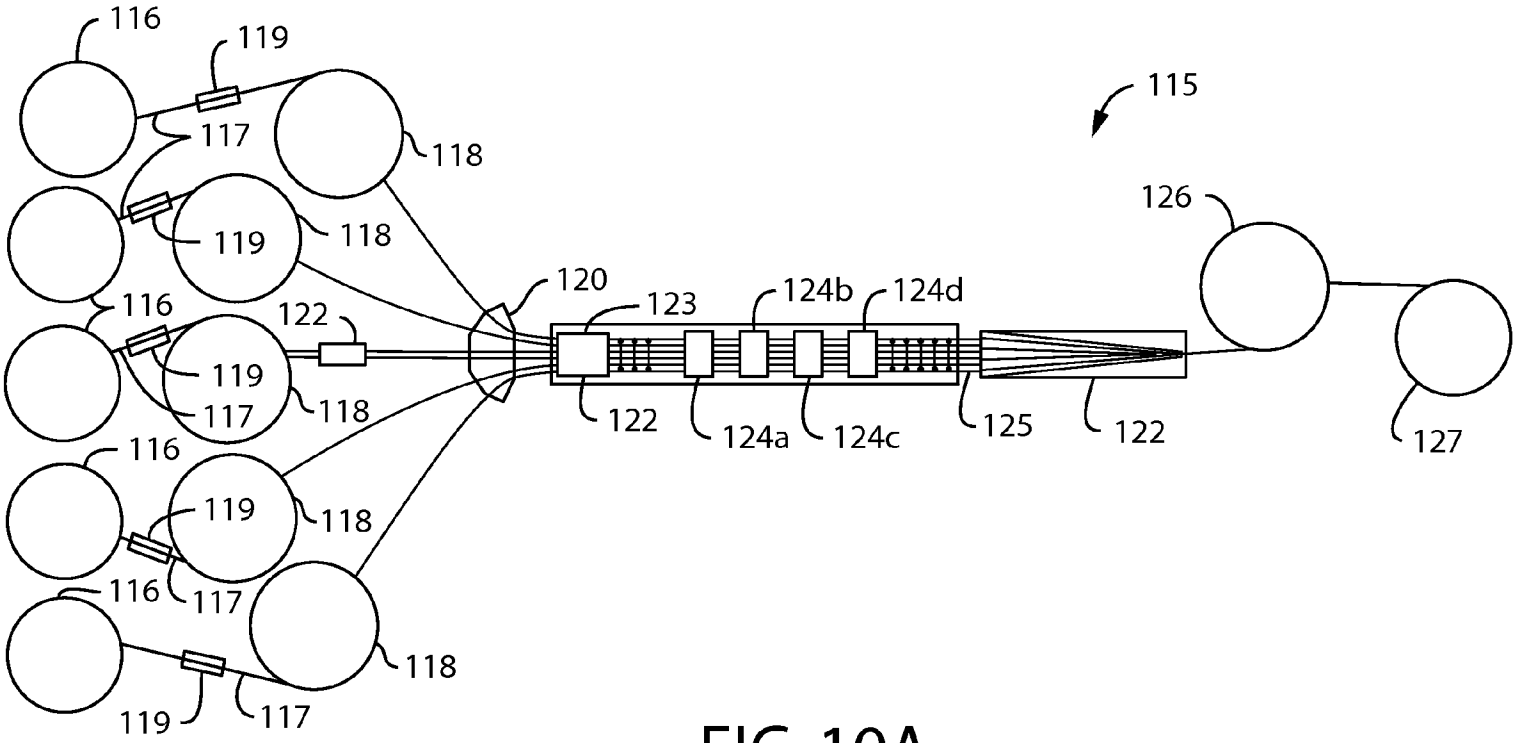
FIG. 10*a* is a schematic view of a continuous welding apparatus for attaching by induction welding a third planar member, a second planar member, a first planar member, a second planar member and a third planar member together to form a composite intermediate product for forming a tube-shaped composite fabrication member.

Referring to FIG. 10*a*, illustrated is a schematic of a continuous welding apparatus 115 for induction welding selected first, second, and third planar members to form a composite planar member 10 suitable for forming a tube-shaped fabrication member 33. The continuous welding apparatus 115 comprises a strip loader 116 for each strip 117 comprised of each individual planar member required to make a composite fabrication member having a desired cross-sectional shape. Shown is an exemplary embodiment of a continuous welding apparatus 115, having five individual strip loaders 116, adapted to uncoil five coils of strip 117, from coilers. The strips 117 comprise, from top to bottom as illustrated, of third planar member 17, second planar member 14, first planar member 11, second planar member 14', and third planar member 17', which, when attached by welding, form a composite intermediate product 10, as shown in FIG. 1. In operation, the loaders 116 uncoil their respective coils of strip, with each strip 117 transported to an accumulator 118, one accumulator 118 for each individual strip 117. The accumulators 118 are adapted to accumulate a large amount of strip allowing sufficient delay to permit for cutting and/or welding of end portions of coils of strip of planar member to enable continuous flow of first planar member 11, second planar members 14 and 14', and third planar members 17 and 17', eliminating the need to continually shutdown and restart the continuous welding apparatus 115 each time a new coil of strip is required. Between each strip loader 116 and each accumulator 118 there may be a strip leveler 119 adapted to selectively position the strip travelling between the strip loader 116 and the accumulator 118.

Each accumulator 118 delivers respective strips 117 to a strip aligner 120, the strip aligner 120 adapted to position each strip 117, such that the third planar member 17, second planar member 14, first planar member 11, second planar member 14', and third planar member 17', are located adjacently aligned in desired positions for attaching together at respective side portions by induction welding in the forming and weld mill 121 to form the composite intermediate product 10. The strip aligner 120 may be adapted to be configured to change the locations in which it positions the individual planar members to achieve different desired composite intermediate products 10. Furthermore, the strip aligner 120 may be adapted to be configured while in use, so that a single composite strip, comprising a composite intermediate product as a continuum of first, second, and third planar members, having varying properties, may be achieved.

The strip aligner 120 delivers the aligned planar members, 11, 14, and 17, to the forming and weld mill 121. A strip deflector 122 may be positioned upstream from the strip aligner 120 adapted to longitudinally rotate the strip, and/or change the elevation of the strip to a desired position, to orient the strip for welding. In some embodiments, the strip deflector 122 of the middle strip, comprising the first planar member 11 may be positioned upstream of the strip aligner 120, while the strip deflector 122 for the strip comprising the other planar members may be integrated with the strip aligner 120, or positioned downstream of the strip aligner 120.

The forming and weld mill 121 may comprise a pair of set rollers 123 adapted to impart a tension onto each strip 117 in preparation for welding. In some embodiments, there may be a set of set rollers 123 adapted to impart a tension into all of the strips, simultaneously; in other embodiments, there may be one set of set rollers 123 for each individual strip, adapted to impart a desired individual tension onto each strip.

The forming and weld mill 121 comprises multiple welding stations 124, each welding station 124*a*, 124*b*, 124*c*, and 124*d* adapted to attach the first planar member 11, the second planar members 14 and 14', and the third planar members 17 and 17' together, at respective side portions by welding, at weld sites 26, 27, 28, and 29, to form a composite strip 125 comprising composite intermediate product 10 as a continuum of third planar member 17, second planar member 14, first planar member 11, second planar member 14', and third planar member 17'. In some embodiments, the induction welding station(s) 124 is adapted to attach side portions of planar members at a rate in excess of 200 ft/min, 300 ft/min, 500 ft/min, 800 ft/min, or 1,000 ft/min.

The continuous welding apparatus 115 may be adapted to form composite strip 125 comprised of two, three planar, or four planar members. Alternatively the continuous welding apparatus 115 may be adapted to form composite strip 125 comprise of five, six or more planar members. For example, in situations where only a two planar member composite intermediate product is desired, the continuous welding apparatus 115 may be operated with only two strip loaders 116, two accumulators 118, and one welding station 124, performing desired functions. The other elements of the continuous welding apparatus 115 may be left dormant. Similarly, it is contemplated that the continuous welding apparatus 115 may be scaled, either up or down, for forming composite strip 125 comprised of any number of planar members, with the addition or subtraction of strip loaders, levelers, deformers, accumulators, and welding stations. The continuous welding apparatus 115 may be laid out such that the accumulators form an arc downstream of the forming and weld mill 121, as illustrated. In other embodiments, the continuous welding apparatus 115 may be laid out such that the accumulators are staggered, some forward of others, or, alternatively, stacked, one above the other, with strip deflectors, deformers, and levelers adapted to bring each strip to the desired position for passing through the forming and weld mill 121.

After the composite strip 125, comprising attached planar members, exits the forming and weld mill 121, the strip may enter a strip deflector 122, adapted to rotate the strip to a desired orientation and/or change the elevation of the strip to a desired position, suitable for passing through an exit strip accumulator 126. An exit strip accumulator 126 may be positioned downstream of the forming and weld mill 121, adapted to accumulate a large amount of composite strip 125 to provide sufficient time for a filled coil at the coiling station 127 to be changed out, eliminating the requirement to continually shutdown and restart the continuous casting apparatus 115 to change out a coil. A shear may be used to cut lengths of strip for coiling. After exiting the strip exit accumulator 126 the composite strip 125, comprising the composite intermediate product 10 may be coiled at a strip coiler 127.

Figure 13A:
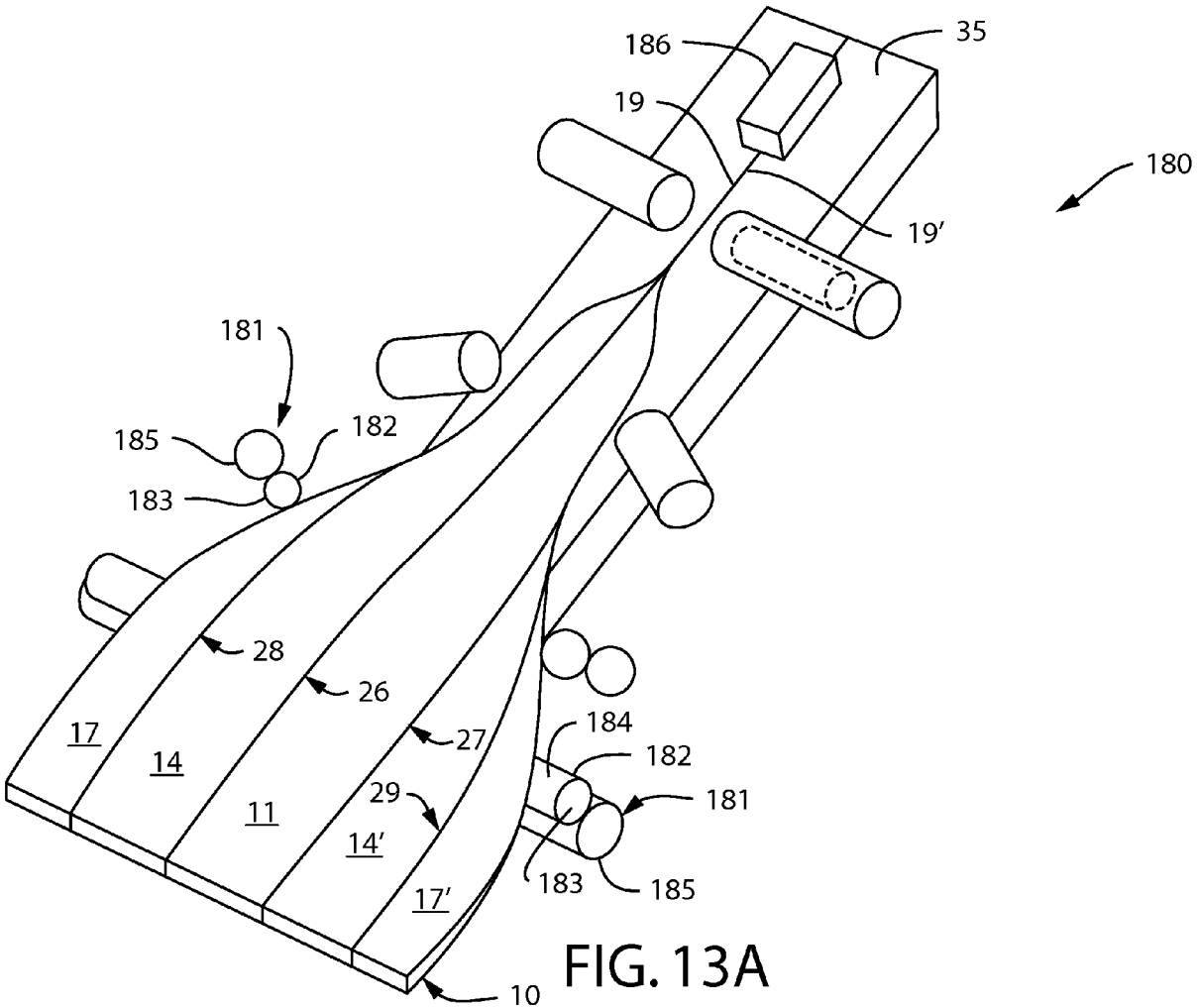
FIG. 13*a* is a perspective view of a cold forming apparatus for cold rolling the composite intermediate product, comprised of third planar member, second planar member, first planar member, second planar member and third planar member, for forming a tube-shaped fabrication member.

In other embodiments, the composite strip 125 may exit the forming and weld mill 121, and, optionally, an exit strip accumulator 122, and may enter a cold-forming mill, such as that shown in FIG. 13*a*, to be formed into a fabrication member having a desired cross-sectional shape of tube-shape.

Figure 10B:
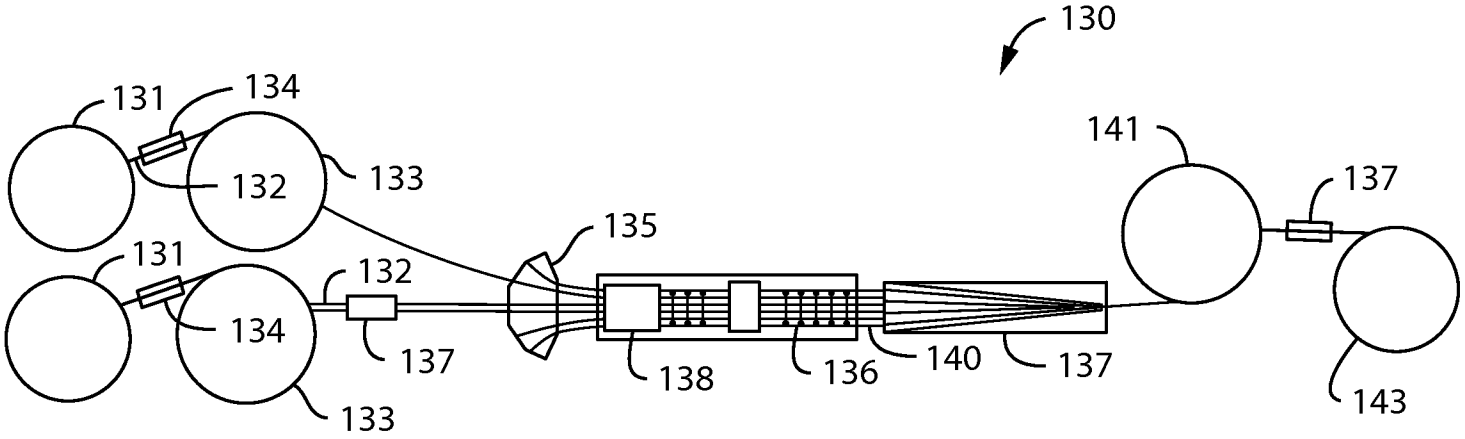
FIG. 10*b* is a schematic view of a continuous welding apparatus for attaching by induction welding a first planar member and a second planar member to form a composite intermediate product for forming a composite fabrication member.

Referring to FIG. 10*b*, illustrated is a schematic of a continuous welding apparatus 130 for attaching first planar member 91 and second planar member 94 at respective side portions by induction welding to form a composite intermediate product 90. The continuous welding apparatus 130 is similar to the welding apparatus shown in FIG. 10*a*, except the continuous welding apparatus 130 comprises fewer elements. The continuous welding apparatus may comprise two strip loaders 131 for each composite strip 140 comprised of each planar member required to make a composite fabrication member 90 having a desired cross-sectional shape. There may be an accumulator 133 associated with each strip loader 131, and, optionally, a strip leveler 134 between the strip loader 132 and the accumulator 133 for each strip 132.

The continuous welding apparatus 130 may comprise a strip aligner 135 adapted to align the two strips 132 such that the strip comprised of the first planar member 91 and the strip comprised of the second planar member 94 may be positioned for welding in the forming and weld mill 136 to form a composite intermediate product 90 for forming into a composite fabrication member of a desired shape.

The forming and weld mill 136 may comprise a pair of set rollers 138 adapted to impart a tension onto each strip 132 in preparation for welding. In some embodiments, there may be a set of set rollers 138 adapted to impart a tension into all of the strips, simultaneously; in other embodiments, there may be one set of set rollers 138 for each individual strip, adapted to impart a desired individual tension onto each strip. The forming and weld mill 136 comprises one or more welding stations, each welding station for welding along a single weld site. The weld and forming mill 136 for forming an intermediate product 90 suitable to form a composite fabrication member having an L-shape may comprise a single welding station 139. In the embodiment illustrated in FIG. 10*b*, the welding station 139 is adapted to attach the first planar member 91 to the second planar member 94 at side portions by induction welding, forming a composite strip 140 comprising the composite intermediate product 90.

As with the embodiment illustrated in FIG. 10*a*, after the composite strip 140 exits the forming and weld mill 136, the strip may enter a strip deflector 137, adapted to rotate the strip to a desired orientation and/or change the elevation of the strip to a desired position, suitable for passing through an exit strip accumulator 141. An exit strip accumulator 141 may be positioned downstream of the forming and weld mill 136, adapted to accumulate a large amount of composite strip 140 to provide sufficient time for a filled coil at the coiling station 142 to be changed out, eliminating the requirement to continually shutdown and restart the continuous casting apparatus 130 to change out a coil. A shear may be used cut lengths of strip for coiling. After exiting the strip exit accumulator 133 the composite strip 140, comprising the composite intermediate product 90, a continuum of first and second planar members, may be coiled at a strip coiler 142.

In other embodiments, the composite strip 140 may exit the forming and weld mill 135, and optionally the exit strip accumulator 141, and may directly enter a cold-forming mill (see FIG. 13) to be formed into composite fabrication members having a desired cross-sectional shape, for example of L-shape or lipped L-shape.

Figure 10C:
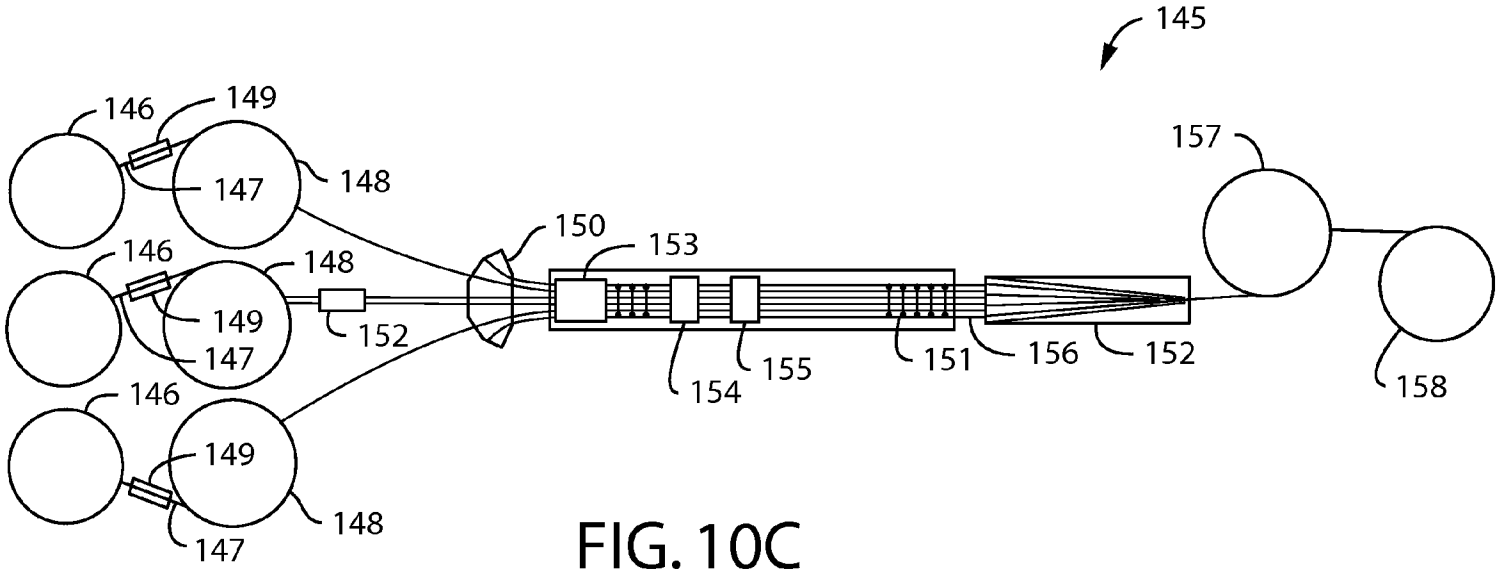
FIG. 10*c* is a schematic view of a continuous welding apparatus for attaching by induction welding first, second, and third planar members to form a composite intermediate product for forming a composite fabrication member.

Referring to FIG. 10*c*. Illustrated is a schematic of a continuous welding apparatus 145 for attaching the selected first, second, and third planar members at respective side portions by induction welding to form a composite intermediate product 60, as shown in FIG. 5. The continuous welding apparatus 145 is similar to the continuous welding apparatus shown in FIG. 10*a*, having fewer elements. The continuous welding apparatus comprises three strip loaders 146, one for each planar member required to make a composite fabrication member having a desired cross-sectional shape. The strip loaders 146 adapted to unravel three coils of strip 147, each strip comprising of first, second, and third planar members. Downstream of the coils there may be a strip leveler 149 adapted to selectively position the strip and a strip accumulator 148.

The strip 147 may exit the strip accumulators 148 and enter the strip aligner 150, adapted to position each strip, such that the first planar member 61, second planar member 62, and third planar member 63 are located in the desired positions for attaching together at respective side portions by welding by the forming and weld mill 151.

The strip aligner 150 delivers the aligned planar members, 61, 62, and 63, to the forming and weld mill 151. A strip deflector 152 may be positioned upstream from the strip aligner 150 adapted to longitudinally rotate the strip, and/or change the elevation of the strip to a desired position, to orient the strip for welding.

Similarly to the embodiments illustrated in FIG. 10*a* and FIG. 10*b*, the forming and weld mill 151 may comprise a pair of set rollers 153 adapted to impart a tension onto each strip. The forming and welding mill 151 comprises one or more welding stations 154. The first welding station 154 may be adapted to weld the first planar member 61 to the second planar member 64 at respective side portions along the length of the planar members. The second welding station 155 may be adapted to weld the third planar member 67 to the opposite edge of the second planar member 64 to form a composite intermediate product 60, a continuum of first, second, and third planar members, at respective side portions, forming a composite strip 156 comprising the composite intermediate product 60. The welding stations 154, 155, may be positioned apart, one downstream from the other, as depicted in FIG. 10*c*, or they may be positioned adjacent to one another, such that first planar member 61 and the third planar member 67 are welded to the second planar member 64 simultaneously.

After the composite strip 156 exits the forming and weld mill 151, the strip may enter a strip deflector 152, adapted to rotate the strip to a desired orientation and/or change the elevation of the strip to a desired position, suitable for passing through an exit strip accumulator 43. An exit strip accumulator 157 may be positioned downstream of the forming and weld mill 151, adapted to accumulate a large amount of composite strip 156 such that a shear may cut lengths of strip for coiling, eliminating the requirement to continually shutdown and restart the continuous casting apparatus 145. After exiting the strip exit accumulator 157 the composite strip 156, comprising the composite intermediate product 60 may be coiled at a strip coiler 158.

Figure 11:
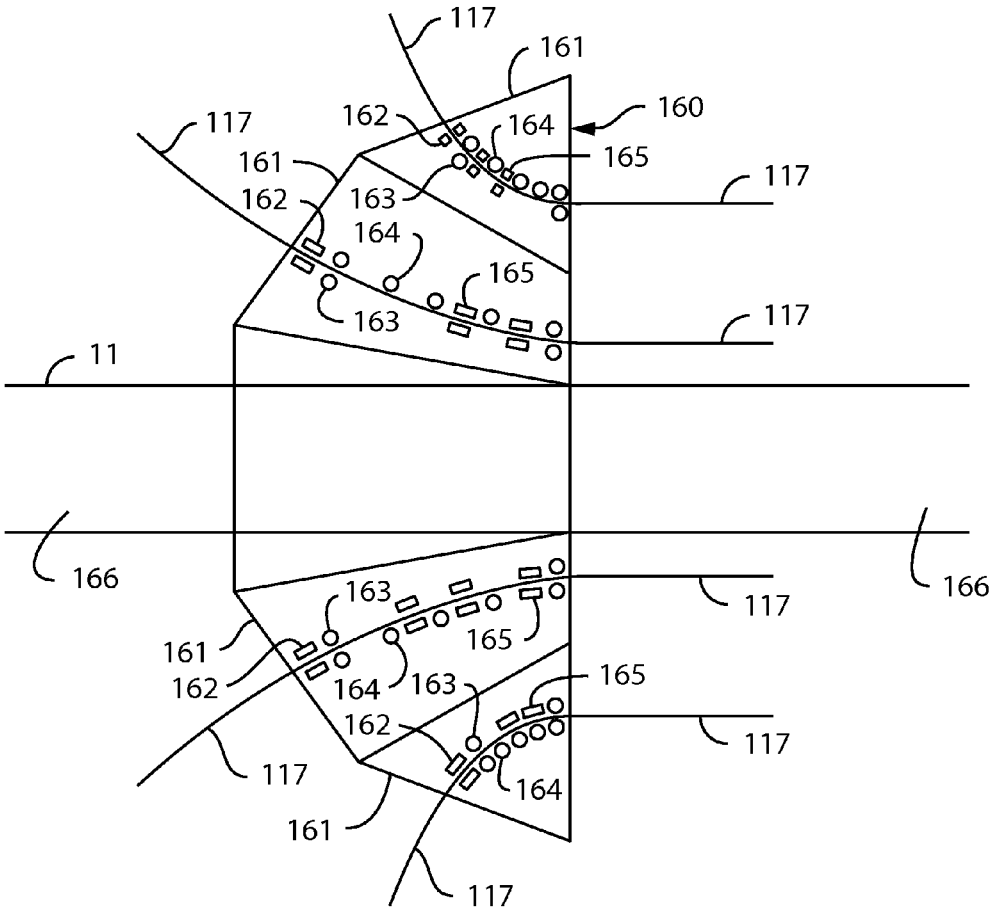
FIG. 11 is an enlarged view of a strip aligner as used in the continuous welding apparatus for forming a tube-shaped structural framing member.

Referring to FIG. 11, illustrated is an enlarged schematic view of the strip alignment apparatus 120 as used in the continuous welding apparatus illustrated in FIG. 10*a*. During operation, each strip 117, comprising a planar member, having a desired cross-section and mechanical properties for forming into a fabrication member with a desired cross-sectional shape and specification, is guided from a strip accumulator to the strip alignment apparatus 120. The strip alignment apparatus 120, comprises multiple individual strip alignment stations 161, one for each strip 117, except for the middle strip 166, to which all other strips may be aligned. Each strip alignment station 161 adapted to align each strip 117 relative to the middle strip 166. The strip aligner 120, may be adapted to both position the strips and also rotate the strips to orient the strips for attachment. Alternatively, as shown, the strip aligner 120 may be adapted to selectively position the strips 117, with the rotation of the strip being performed downstream, for example, at the forming and weld mill.

Each individual strip alignment station 161, comprises a guide block 162 and a pair of entry rollers 163 at the entrance to the strip alignment stations 161. The guide block 162 and pair of entry rollers 163 adapted to receive the strip 117 in a desired position for passage through the strip alignment stations 161. The strip alignment stations 161 each have a plurality of guide rolls 164 and guide blocks 165, adapted to guide the strip 117 around the curve formed by the strip alignment stations 161, bringing the strip 117 in alignment with the middle strip 166, positioned at a desired position for entry into the forming and weld apparatus 121.

Figure 12:
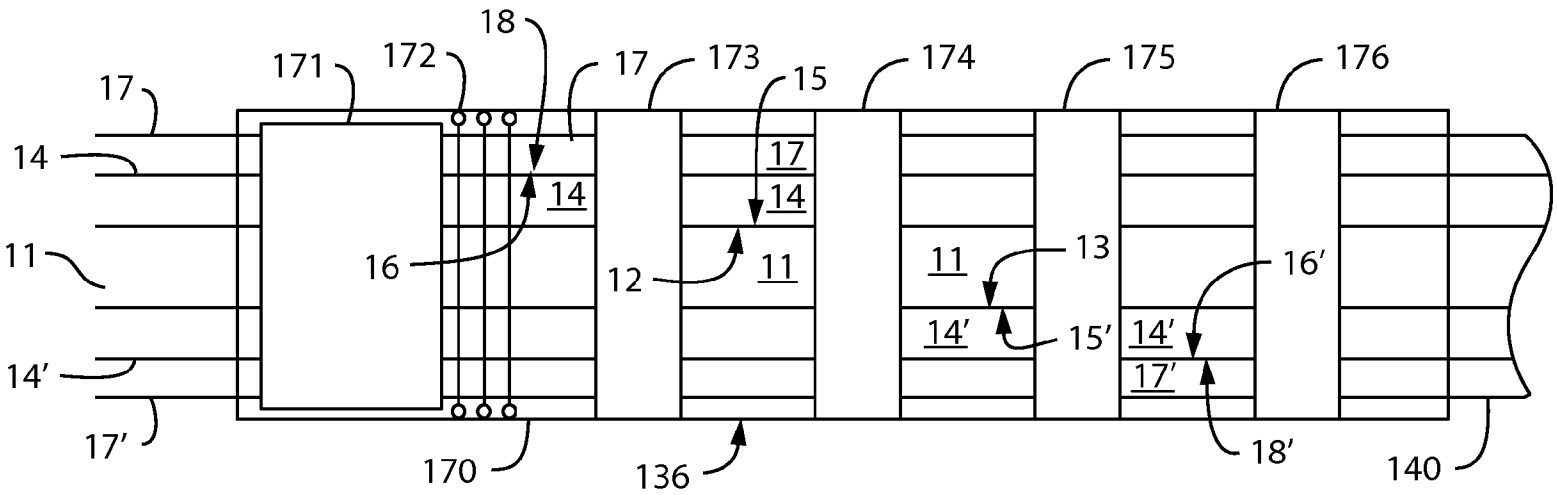
FIG. 12 is an enlarged view of a forming and weld apparatus as used in the continuous welding apparatus for forming a tube-shaped structural framing member.

Referring to FIG. 12. Illustrated is an enlarged schematic view of the forming and weld apparatus 136, for use in the continuous welding apparatus shown in FIG. 10*a*. The forming and weld apparatus 136 may have a welding table or bench 170 adapted to support the elements of the forming and weld apparatus 136. In operation, the individual strips, 117, comprised of second and third planar members, exits the strip aligner 120 and enters the forming and weld mill 136. The outside strips 117, comprised of second and third planar members may be orientated at a different angle compared to the orientation of the middle strip 166, comprised of the first planar member 11. In such embodiments, as shown, the strips 117 enter a strip deflector 122 adapted to longitudinally rotate the strip 117 to a desired orientation for welding to respective side portions of adjacent planar members.

Sensors 172, may be located downstream of the strip deflector 171 adapted to measure the positions of the strip 117 relative to the middle strip 166 and each other. The sensors 172 may be connected to a computer (not shown) adapted to analyze the data produced by the sensors to determine the positions of the strips 117, and also actively control the function of the strip aligner 120 and the strip deflector 171 to ensure correct positioning of the strips 117 for welding. The strips 117, and 166 pass through a first welding station 173, adapted to attach side portions of one of the outer-most strips to the adjacent strip by welding, thereby welding a first side portion 18 of one of the third planar members 17 to a first side portion 15 of one of the second planar members 14. Subsequently, the combined strip, comprised of the attached third and second planar members, and the unattached strips 117 comprised of the first planar member 11, and the other, second planar member 14' and third planar member 17', pass through a second welding station 174. The second welding station 174 adapted to attach the middle strip 166, comprised of the first planar member 11, to the now combined third planar member 17 and second planar member 14, at side portions by welding. As such, the second welding station 174 attaches the first side portion 12 of the first planar member 11 to the first side portion 15 of the second planar 14 member by welding. Similar welds are performed at the third welding station 175 and fourth welding station 176 until all of the individual strips 117, comprising of first, second, and third planar members, are attached at side portions by welding, to form a composite strip 140 as a continuum of first, second, and third planar members. The welding stations comprise induction welders adapted to attach side portions of planar members together at a rate in excess of 200 ft/min, 300 ft/min, 500 ft/min, 800 ft/min, or 1,000 ft/min.

Figure 13B:
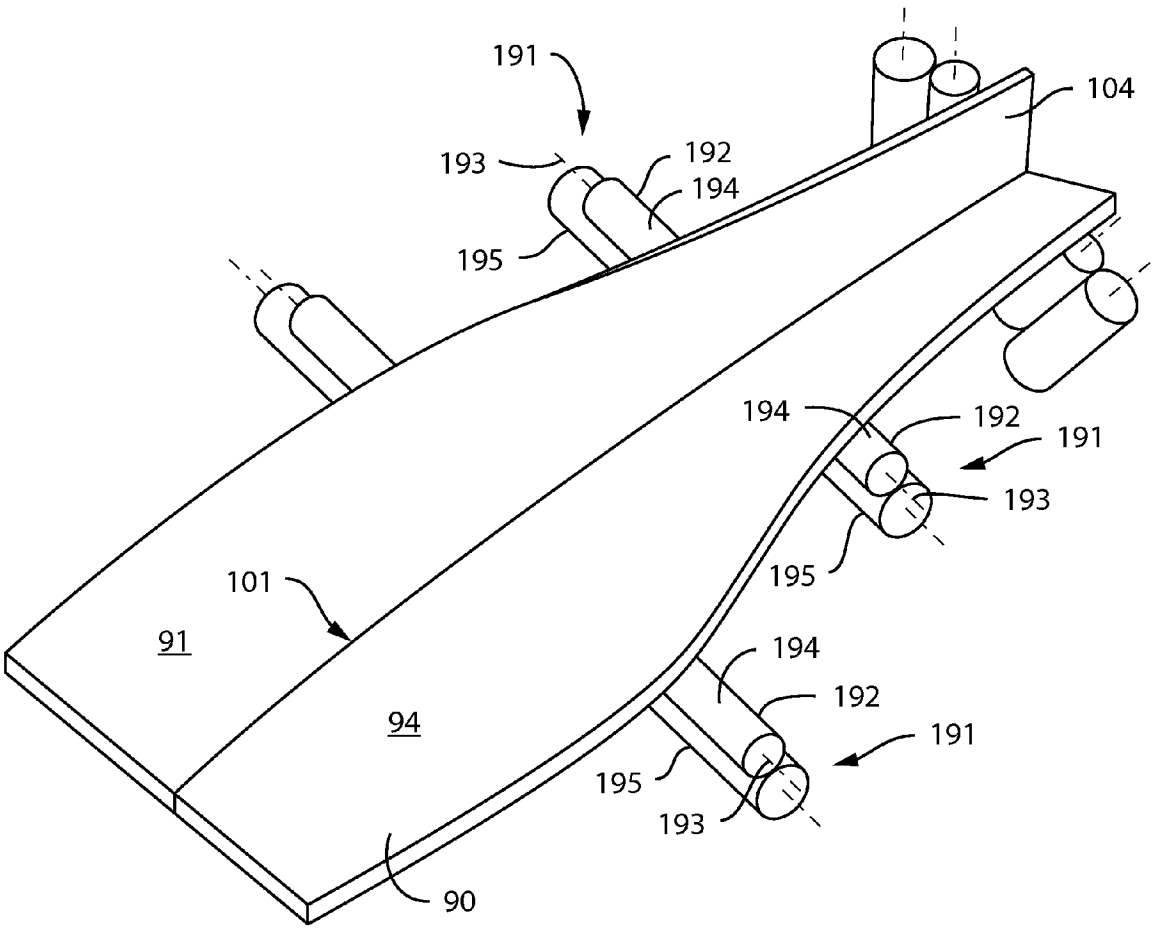
FIG. 13*b* is a perspective view of a cold forming apparatus for cold rolling the composite intermediate product, comprised of first planar member and second planar member, for forming an composite fabrication member having an L-shape.

Referring to FIGS. 13*a* and 13*b*, illustrated are perspective views of cold forming mills adapted to cold form composite planar members, a continuum of multiple planar members, into composite fabrication members. The cold-forming mills for cold forming the composite strip, comprising composite planar members, may be configured for forming composite fabrication members of a desired shape. The composite strip may be cold-rolled immediately subsequent to the formation of the composite strip, comprising the composite intermediate product, a continuum of multiple planar members, or, in the alternative, the composite strip may be coiled by a coiler and transported to a cold-rolling mill. It is contemplated that the composite strip, comprising a composite intermediate product formed from the presently disclosed methods, may be cold-rolled in existing cold-rolling mills with little to no modifications being made to the cold-rolling mill.

Referring to FIG. 13*a*, illustrated is a cold-forming apparatus, or cold-rolling apparatus, adapted to form a tube-shaped structural framing member 33 from a composite strip 125, comprised of a composite intermediate product 10, a continuum of third planar member 17, second planar member 14, first planar member 11, second planar member 14', and third planar member 17'. The cold-rolling mill 180 may comprise an entry guide (not shown) adapted to properly align the composite strip 125 as it passes through the roll sets 181 of the cold-forming rolling mill 180. The entry guide may be adapted to selectively position the composite strip 125, comprising a composite planar member 10. To ensure the composite fabrication member 44 meets the desired load-bearing specifications it is usually necessary to form the incoming composite strip 125 such that the bends 37 in the composite planar member 10 are positioned on the generally thicker flange members 34, 35 as opposed to the web portions 36. Alternatively, it may be desirable to further reduce the material in the composite fabrication member 33 and form the composite strip 125 such that the bend 37 in the composite planar member 10 is positioned on the web portion 36, having less material than the flange portions 34, 35 or at or near the transition between the web portion 36 and the flange portion 34, 35.

The cold-rolling mill 180 may comprise multiple roll sets 181, each roll set comprising a work roll 182, having a rolling face 184, rotating about a work roll axle 183, and a driving roll 185, adjacent the work roll 182, adapted to engage the work roll 182 to rotate the work roll 182, and impart lubricating oil onto the rolling face 183 of the work roll 182. Each roll face 184 may be shaped to impart a desired cross-sectional shape onto the composite strip 125 to provide a tube-shaped composite fabrication member 33. There may be successive roll sets 181, each roll set 181 adapted to further mold the composite strip 125 until the composite strip 125 has the desired cross-sectional shape. Furthermore, each consecutive roll set 181 may have work rolls 182 mounted on roll set axles 183 positioned at differing angles, such that each consecutive roll set 181 may impart an increased bend in the composite strip 125, relative to the previous roll set. Alternatively, a single roll set 181 may be sufficient to mold the composite strip 125 into the desired cross-sectional shape. Each roll set 181 may have a complimentary work roll opposite the work roll 182 shown in the figure to further assist in the shaping of the composite intermediate product 10 into a tube-shaped fabrication member 33.

Each successive work roll axis 183 positioned differently than the previous work roll axis to further form the composite intermediate product 10 into the tube-shaped fabrication member 33.

A welding station 186 may be positioned immediately subsequent to the cold-rolling apparatus 180 for attaching the second side portions 19 and 19' of the third planar members 17 and 17' together by welding, thus forming a flange 35 of the tube-shaped fabrication member 33. Alternatively, the welding station may be disassociated with the cold-rolling mill 180, the tube-shaped fabrication member 33 being transported from the rolling mill 180 to the welding station for final construction. Such a welding station may comprise an induction welder adapted to attach together second side portions 19 and 19' of the third planar member 17 and 17'.

Referring to FIG. 13*b*, illustrated is a cold forming mill 190 for cold-rolling composite strip 90 to form a composite fabrication member 104 having an L-shape. A similar cold-rolling mill may be used to form lipped L-shaped composite fabrication members 109. Such cold-rolling mills are similar to the cold-rolling mill illustrated in FIG. 13*a*. A cold-rolling mill 190 for forming simpler shapes, such as a composite fabrication member 104 having an L-shape, may have fewer roll-sets 191, than a cold-rolling mill for forming more complicated composite fabrication members, such a tube-shaped fabrication member 33 shown in FIG. 13*a*.

The composite fabrication member 104, or 109, may be positioned such that a bend 108 is formed in the composite planar member 90 on the generally thicker flange member 105, as opposed to the web portion 106, to ensure that the composite fabrication member 104, or 109, meets a desired specification. Alternatively, it may be desirable to further reduce the material in the composite fabrication member 104, or 109, and position the composite strip 140 such that the bend 108 in the composite planar member 90 is positioned on the web portion 106, having less material than the flange portions 105, or at or near the transition between the web portion 106 and the flange portion 105.

The cold-rolling mill 190 may comprise multiple roll sets 191, each roll set comprising a work roll 192, having a rolling face 194, rotating about a work roll axle 193, and a driving roll 195, adjacent the work roll 192, adapted to rotate the work roll 192, and impart lubricating oil onto the rolling face 193 of the work roll 192. Each roll face 194 may be shaped to impart a desired cross-sectional shape onto the composite strip 140 to provide a composite fabrication member 104, or 109, having a desired cross-sectional shape of L-shape, or lipped L-shape. As discussed above with reference to FIG. 13*a*, a single roll set 191 may be sufficient to mold the composite strip 140 into the desired cross-sectional shape. Each roll set 191 may have a complimentary work roll opposite the work roll 192 shown in the figure to further assist in the shaping of the composite intermediate product 90 into a fabrication member 104 having an L-shape, or a fabrication member 109 having a lipped L-shape.

In alternative embodiments, the roll sets may be positioned vertically, one roll positioned above the composite strip and a second roll positioned oppositely below the composite strip. Each pair of rolls having a complimentary roll face adapted to impart a shape into the material. At each roll set, there may be a second side roll set, having axles positioned perpendicular to the axles of the first roll set. The side roll set may be adapted to provide greater precision, flexibility, further support and shaping of the composite strip, and to reduce stresses on the material. Furthermore, multiple cold-rolling mills may be utilized to provide a composite fabrication member having a desired cross-sectional shape.

In any embodiment, shears may be provided upstream of the cold-rolling mill, between cold-rolling mills, or downstream of the cold-rolling mill, adapted to cut the composite strip, or cold-formed composite strip, into discrete lengths, as desired, to form composite fabrication members, and having a desired cross-sectional shape.

In any cold-forming mill the roll sets may have a roll face adapted to impart perforations, embossments, and knurling into the planar portions of the composite fabrication members. Alternatively, perforations may be formed by a stamping apparatus, adapted to make perforations of a desired shape and dimension in the web portions of flange portions of the composite fabrication member. Such stamping may be performed simultaneously with cold-forming, prior to cold-forming, or after cold-forming. Alternatively the planar members may be provided with perforations prior the step of attaching the planar members together at respective side portions to form a composite intermediate product. Similarly, embossments and knurling may be formed by a stamping apparatus before, during, or after cold-forming, or the planar members may be provided having desired knurling and embossments prior to the step of attaching the planar members together.

A composite fabrication member may be adapted for use as an interior dry-wall stud, having perforations of a desired shape and size at desired locations to functions as conduits for plumbing and electrics. Such perforations may form any shape, for example oval-shaped, circular-shaped, square-shaped, rectangular shaped or key-hole shaped. Embossments in the web member, for example, may be adapted to provide enhanced strength to the composite fabrication member, further allowing a reduction in the material used to form a composite fabrication member having a desired set of mechanical properties. Such embossments may be diamond shaped. Embossments, such as ribs, formed in the flange portions of the composite fabrication member may increase the torsional load carrying capabilities of the composite fabrication member, further providing avenues for increasing the efficiency and effectiveness of the composite fabrication member. The composite fabrication member may undergo planking to increase the torsional strength of the composite fabrication member. Knurling may be provided in the composite fabrication member to act as guide-holes for fasteners, adapted to guide fasteners to a desired location when being placed in the fabrication member, reducing the tendency for fasteners to slide and skip on the surface of the composite fabrication member during installation of the fastener.

The features of the composite fabrication member may be provided in the individual planar members prior to attaching the planar members together. Alternatively, the composite intermediate product may be passed through a stamping or forming mill to impart desired features in the composite intermediate product. Alternatively, the cold-rolling mill adapted to form the composite fabrication member may also be adapted to impart a desired set of features into the composite fabrication member while forming the composite fabrication member.

While it has been described with reference to certain embodiments, it will be understood by those skilled in the art that various changes may be made and equivalents may be substituted without departing from scope. In addition, many modifications may be made to adapt a particular situation or material to the teachings without departing from its scope. Therefore, it is intended that it not be limited to the particular embodiments disclosed, but that it will include all embodiments falling within the scope of the appended claims.

What is claimed is:

1. A method of making a composite tube-shaped fabrication structure member adapted for use in one of a building and a vehicle comprising the steps of:

providing a first coil of a strip of a first planar member having a desired cross-sectional shape and a desired first set of mechanical properties suitable to form a flange of a tube-shaped fabrication structure member for a building or vehicle;

providing two second coils each of a strip of a second planar member having a desired second cross-sectional shape and a desired second set of mechanical properties different from the first planar member suitable to form web portions of a tube-shaped fabrication structure member for a building or vehicle;

providing two third coils each of a strip of a third planar member having a desired third cross-sectional shape and a desired third set of mechanical properties different from the second planar member suitable to form a portion of a flange of the tube-shaped fabrication structure member for a building or vehicle;

uncoiling and passing through accumulators the strip of the first planar member, the strips of the second planar member, and the strips of the third planar member, the accumulators allowing sufficient delay to permit for welding of end portions of the strips to enable continuous flow of the strip of first planar member from the first coil, the strips of the second planar members from the two second coils, and the strips of the third planar members from the two third coils;

delivering the strip of the first planar member, the strips of the second planar member, and the strips of the third planar member to a strip aligner to provide aligning respective side portions of the strip of the first planar member and a side portion of each of the strips of the second planar member for attachment to the respective side portions of each of the strips of the second planar member and for attachment of the respective side portions of the strips of the third planar member from the two third coils to the opposite side portions of the second planar member;

delivering the strip of the first planar member, the strips of the second planar member, and the strips of the third planar member to a weld apparatus having multiple welding stations to provide attaching respective side portions of the strip of the first planar member from the first coil and side portions of two strips of the third planar member from the two third coils to respective side portions of the two strips of the second planar member from the two second coils by welding to form a composite intermediate product as a continuum suitable for forming a tube-shaped fabrication structure member; and delivering the composite intermediate product to a cold-forming apparatus to provide cold-forming the composite intermediate product to form a tube-shaped fabrication structure member adapted for use in one of a building and a vehicle.

2. The method of forming a composite tube-shaped fabrication structure member as claimed in claim 1 where the first planar member forms a flange portion, the second planar members forms web portions, and the two third planar members form portions of a flange portion of the tube-shaped fabrication structure member.

3. The method of forming a composite tube-shaped fabrication structure member as claimed in claim 1 where the step of cold-forming imparts bends in the first and third planar members adjacent transitions between the first and second planar members and the second and third planar members respectively to form the tube-shaped fabrication structure member in a box shape.

4. The method of forming a composite tube-shaped fabrication structure member as claimed in claim 1 where the step of cold-forming imparts a profile into the first, second and third planar members to form the tube shaped fabrication structure member in a curvilinear-shape.

5. The method of making a composite tube-shaped fabrication structure member as claimed in claim 1, further comprising the step of:

attaching respective side portions of the two third planar members together by welding to form a continuous flange of the tube-shaped fabrication member.

6. The method of making a composite tube-shaped fabrication structure member as claimed in claim 1 where the respective side portions of the first planar member and side portions of third planar members overlap with respective side portions of the second planar members prior to welding.

7. The method of making a composite tube-shaped fabrication structure member as claimed in claim 1 where the second planar members has a thicknesses less than thicknesses of the first and third planar members.

8. The method of making a composite tube-shaped fabrication structure member as claimed in claim 1 where the third planar members have a thicknesses less than thicknesses of the first and second planar members.

9. The method of making a composite tube-shaped fabrication structure member as claimed in claim 1 wherein the first, second, and third planar members are made of steel or aluminum or alloys thereof and each has a different composition.

10. The method of making a composite tube-shaped fabrication structure member as claimed in claim 1 wherein the first and third planar members are made of a steel or aluminum or alloy-composition different in composition from the steel or aluminum or alloy thereof composition of the second planar members.

11. The method of making a composite tube-shaped fabrication structure member as claimed in claim 1 wherein the step of attaching the first and third planar members to the second planar members is performed with the step of cold-forming to form a composite fabrication structure member having a tube-shape.

12. The method of making a composite tube-shaped fabrication structure member as claimed in claim 5 wherein the step of attaching the two third planar members by welding to form the tube-shaped composite fabrication member is performed with the step of cold-forming to form a composite fabrication structure member having a tube-shape.

13. The method of making a composite tube-shaped fabrication structure member as claimed in claim 1 further comprising the step of forming perforations into the composite fabrication structure member.

14. The method of making a composite tube-shaped fabrication structure member as claimed in claim 1 further comprising the step of forming perforations into the composite intermediate product.

15. The method of making a composite tube-shaped fabrication structure member as claimed in claim 1 wherein the step of cold-forming imparts embossments into the composite fabrication member.

16. The method of making a composite tube-shaped fabrication structure member as claimed in claim 1 further comprising the step of forming knurling into the composite intermediate product.

17. A method of making a composite intermediate structure fabrication product adapted for use in one of a building and a vehicle comprising the steps of:

providing a coil of a strip of a first planar member having a desired cross-sectional first shape and suitable to form a flange of a tube-shaped fabrication structure member for a building or vehicle;

providing two second coils each of a strip of second planar member having a desired second cross-sectional shaped different from the first planar member and suitable to form a web portion of a tube-shaped fabrication structure member for a building or vehicle;

providing two third coils each of a strip of a third planar member having a desired third cross-sectional shape and suitable to form a portion of a flange of the tube-shaped member for a building or vehicle;

uncoiling and passing through accumulators the strip of the first planar member, the strips of the second planar member, and the strips of the third planar member, the accumulators allowing sufficient delay to permit for welding of end portions of the strips to enable continuous flow of the strips of the first planar member, the second planar members, and the third planar members;

delivering the strip of the first planar member, the strips of the second planar member, and the strips of the third planar member to a strip aligner to provide aligning respective side portions of first planar member and side portions of the second planar members for attachment to respective side portions of the second planar members and respective side portions of the third planar members; and delivering the strip of the first planar member, the strips of the second planar member, and the strips of the third planar member to a weld apparatus having multiple welding stations to provide attaching respective side portions of the first planar member and the two third planar members to respective side portions of the two second planar member by welding to form a composite intermediate product as a continuum of the third planar members, the second planar member, and the first planar member suitable for forming a tube-shaped composite fabrication structure member adapted for use in one of a building and a vehicle.

18. The method of making a composite intermediate fabrication structure product as claimed in claim 17, where the respective side portions of the first planar member and the respective side portions of the third planar members overlap with respective side portions of the second planar members prior to welding.

19. The method of making a composite intermediate fabrication structure product as claimed in claim 17, where the third planar members has a thicknesses less than thicknesses of the first planar member and the second planar members.

20. The method of making a composite intermediate fabrication structure product as claimed in claim 17, where the second planar members have a thicknesses less than thicknesses of the first planar member and the third planar members.

21. The method of making a composite intermediate fabrication structural product as claimed in claim 17, where the first, second, and third planar members are made of steel or aluminum or alloys thereof, having different compositions.

22. The method of making a composite intermediate fabrication structural product as claimed in claim 17, where the first and third planar members are made of a steel or aluminum or alloys thereof, being a different composition from a steel or aluminum or alloys thereof of the second planar members.

23. The method of making a composite intermediate fabrication structure product as claimed in claim 17, further comprising the step of forming perforations into the composite intermediate product.

24. The method of making a composite intermediate fabrication structure member as claimed in claim 17 further comprising the step of forming embossments into the composite intermediate product.

25. The method of making a composite intermediate fabrication structure member as claimed in claim 17 further comprising the step of forming knurling into the composite intermediate product.

26. A method for making a tube-shaped fabrication structure member adapted for use in one of a building and a vehicle comprising the step of:

providing a first coil of a strip of a first planar members having a desired first cross-sectional shape and a desired first set of properties suitable to form a first part of a tube-shaped composite fabrication structure member for a building or vehicle;

providing a second coil of a strip of a second planar member having a desired second cross-sectional shape and a desired second set of properties different from the first set suitable to form a second part of a tube-shaped composite fabrication structure member for a building or vehicle;

uncoiling and passing through accumulators the strip of the first planar member and the strip of the second planar member, the accumulators allowing sufficient delay to permit for welding of end portions of the strips to enable continuous flow of first planar member, and second planar member;

delivering the strip of the first planar member and, the strip of the second planar member to a strip aligner to provide aligning the side portions of the first planar member and the second planar member for attachment;

delivering the strip of the first planar member and the strip of the second planar member to a weld apparatus having multiple welding stations to provide attaching the first and second planar members together at the side portions adjacent each other by welding to form a composite intermediate product as a continuum of the first and second planar members, suitable for forming into a tube-shaped composite fabrication structure member; and delivering the composite intermediate product to a cold-forming apparatus to provide cold-forming the composite intermediate product to bend non-joined side portions of the first and second planar members and attaching at the respective side portions of the first and second planar members by welding to form a tube-shaped composite fabrication structure member adapted for use in one of a building and a vehicle.

27. The method of forming a tube-shaped fabrication structure member as claimed in claim 26, where the step of cold-forming includes imparting bends in the first planar member, the first planar member having a thickness greater than a thickness of the second planar member, where the tube-shaped fabrication structure member is in a form of a box-shape.

28. The method of forming a tube-shaped fabrication structure member as claimed in claim 26, where the step of cold-forming includes imparting bends in the second planar member, the first planar member having a thickness greater than thickness of the second planar member, where the tube shaped fabrication structure member is in a form of a box-shape.

29. The method of forming a tube-shaped fabrication structure member as claimed in claim 26, where the step of cold-forming includes imparting a profile to the first and second planar members where the tube shaped fabrication structure member is curvilinear-shape.

30. A method for making a composite intermediate structure fabrication product to form a tube-shaped structure fabrication member adapted for use in one of a building and a vehicle comprising the steps of:

providing a first coil of a strip of a first planar member having a desired first set of mechanical properties and a desired first cross-sectional shape, suitable to form a first part of a tube-shaped structure fabrication member for a building or vehicle;

providing a second coil of a strip of a second planar member having a desired second set of mechanical properties different from the first planar member and a desired second cross-sectional shape suitable to form a second part of a tube-shaped fabrication member for a building or vehicle;

uncoiling and passing through accumulators the strip of the first planar member, and the strip of the second planar member, the accumulators allowing sufficient delay to permit for welding of end portions of the strips to enable continuous flow of the first planar member and the second planar member;

delivering the strip of the first planar member and the strip of the second planar member to a strip aligner to provide aligning a first side portion of the first planar member with a first side portion of the second planar member for attachment; and, delivering the strip of the first planar member and the strip of the second planar member to a weld apparatus having multiple welding stations to provide attaching the first planar member and the second planar member together at respective side portions by welding, forming a composite intermediate structure fabrication product as a continuum of the first planar member and the second planar member.

* * * * *